US008566106B2

(12) United States Patent
Salami et al.

(10) Patent No.: US 8,566,106 B2
(45) Date of Patent: Oct. 22, 2013

(54) METHOD AND DEVICE FOR FAST ALGEBRAIC CODEBOOK SEARCH IN SPEECH AND AUDIO CODING

(75) Inventors: Redwan Salami, St-Laurent (CA); Vaclav Eksler, Sherbrooke (CA); Milan Jelinek, Sherbrooke (CA)

(73) Assignee: Voiceage Corporation, Quebec (CA)

( * ) Notice: Subject to any disclaimer, the term of this patent is extended or adjusted under 35 U.S.C. 154(b) by 720 days.

(21) Appl. No.: 12/676,004

(22) PCT Filed: Sep. 11, 2008

(86) PCT No.: PCT/CA2008/001620
§ 371 (c)(1),
(2), (4) Date: Jun. 11, 2010

(87) PCT Pub. No.: WO2009/033288

PCT Pub. Date: Mar. 19, 2009

(65) Prior Publication Data

US 2010/0280831 A1 Nov. 4, 2010

Related U.S. Application Data

(60) Provisional application No. 60/960,006, filed on Sep. 11, 2007.

(51) Int. Cl.

| | |
|---|---|
| ***G10L 19/00*** | (2013.01) |
| ***G10L 21/04*** | (2013.01) |
| ***G10L 19/12*** | (2013.01) |
| ***G10L 19/14*** | (2006.01) |
| ***G10L 19/02*** | (2013.01) |
| ***G10L 13/00*** | (2006.01) |

(52) U.S. Cl.

USPC ..... 704/500; 704/501; 704/502; 704/503; 704/504; 704/216; 704/217; 704/219; 704/223; 704/225; 704/229; 704/258; 704/262; 704/263; 704/264

(58) Field of Classification Search

USPC ..... 704/216, 217, 219, 223, 225, 229, 258, 704/262, 263, 264, 500–504

See application file for complete search history.

(56) References Cited

U.S. PATENT DOCUMENTS 5,699,482 A * 12/1997 Adoul et al. ..... 704/219
5,701,392 A * 12/1997 Adoul et al. ..... 704/219

(Continued)

FOREIGN PATENT DOCUMENTS

EP 1 225 568 7/2002
JP 2000-515998 11/2000

(Continued)

OTHER PUBLICATIONS

Lee, E.D.;Yun, S.H.; Lee, S.I.; Ahn, J.M., Iteration-free pulse replacement method for algebraic codebook search, Jan. 4, 2007, IEEE, vol. 43; Issue 1, pp. 59-60.*

(Continued)

*Primary Examiner* — Edgar Guerra-Erazo
(74) *Attorney, Agent, or Firm* — Fay Kaplun & Marcin, LLP

(57) ABSTRACT

A method and device for searching an algebraic codebook during encoding of a sound signal, wherein the algebraic codebook comprises a set of codevectors formed of a number of pulse positions and a number of pulses distributed over the pulse positions. In the algebraic codebook searching method and device, a reference signal for use in searching the algebraic codebook is calculated. In a first stage, a position of a first pulse is determined in relation with the reference signal and among the number of pulse positions. In each of a number of stages subsequent to the first stage, (a) an algebraic codebook gain is recomputed, (b) the reference signal is updated using the recomputed algebraic codebook gain and (c) a position of another pulse is determined in relation with the updated reference signal and among the number of pulse positions. A codevector of the algebraic codebook is computed using the positions of the pulses determined in the first and subsequent stages, wherein a number of the first and subsequent stages corresponds to the number of pulses in the codevectors of the algebraic codebook.

33 Claims, 5 Drawing Sheets

(56) References Cited

U.S. PATENT DOCUMENTS

| | | | | |
|---|---|---|---|---|
| 5,717,825 | A * | 2/1998 | Lamblin | 704/223 |
| 5,754,976 | A | 5/1998 | Adoul et al. | |
| 5,867,814 | A * | 2/1999 | Yong | 704/216 |
| 5,893,061 | A * | 4/1999 | Gortz | 704/262 |
| 5,924,062 | A * | 7/1999 | Maung | 704/219 |
| 6,073,092 | A * | 6/2000 | Kwon | 704/219 |
| 6,104,992 | A * | 8/2000 | Gao et al. | 704/220 |
| 6,161,086 | A * | 12/2000 | Mukherjee et al. | 704/207 |
| 6,295,520 | B1 * | 9/2001 | Tian | 704/223 |
| 6,385,576 | B2 * | 5/2002 | Amada et al. | 704/223 |
| 6,539,516 | B2 * | 3/2003 | Cameron | 714/785 |
| 7,117,146 | B2 * | 10/2006 | Gao | 704/200.1 |
| 2001/0053972 | A1 * | 12/2001 | Amada et al. | 704/220 |
| 2002/0103638 | A1 * | 8/2002 | Gao | 704/207 |
| 2002/0111800 | A1 * | 8/2002 | Suzuki et al. | 704/220 |
| 2004/0172402 | A1 | 9/2004 | Jabri et al. | |
| 2004/0181400 | A1 | 9/2004 | Kannan et al. | |
| 2006/0074641 | A1 | 4/2006 | Goudar et al. | |
| 2006/0116872 | A1 | 6/2006 | Byun et al. | |
| 2006/0149540 | A1 | 7/2006 | Singh et al. | |
| 2007/0150266 | A1 | 6/2007 | Li et al. | |

FOREIGN PATENT DOCUMENTS

| | | |
|---|---|---|
| JP | 2003-308100 | 10/2003 |
| JP | 2005-515486 | 5/2005 |
| JP | 2006-504123 | 2/2006 |
| WO | 98-05030 | 2/1998 |
| WO | 03-058407 | 7/2003 |
| WO | 2004-038924 | 5/2004 |

OTHER PUBLICATIONS

Chen, F.-K.;Yang, J.-F. ; Yan, Y.-L., Candidate scheme for fast ACELP search, Feb. 2002, IEEE, vol. 149;Issue: 1, pp. 10-16.*

Wang, M.-L.;Yang, J.-F., Generalised candidate scheme for the stochastic codebook search of scalable, IEEE, vol. 151; Issue: 5, pp. 443-452.*

PravinKumar, R., High Computational Performance in Code Exited Linear Prediction Speech Model Using Faster Codebook Search Techniques, Oct. 30, 2004, IEEE, vol. 151; Issue: 5, pp. 443-452.*

Nam Kyu Ha, A fast search method of algebraic codebook by reordering search sequence, Mar. 15-19, 1999, IEEE, vol. 1, pp. 21-24.*

Hochong Park;Younchang Choi ; Doyoon Lee, Efficient codebook search method for ACELP speech codecs, Oct. 6-9, 2002, IEEE, pp. 17-19.*

De Meuleneire M.;Siemens CT IC; Munich Gartner M.; Schandl S.;Taddei, H., An Enhancement Layer for ACELP Coder , Oct. 3-6, 2006, IEEE, pp. 124-127.*

Salami et al., "A Toll Quality 8 KB/S Speech Codec for the Personal Communications System (PCS)", IEEE Transactions on Vehicular Technology, vol. 43, No. 3, Aug. 1994, pp. 808-816.

Bessette et al., "The Adaptive Multi-Rate Wideband Speech Codec (AMR-WB)" IEEE Transactions on Speech and Audio Processing, vol. 10, No. 8, Nov. 2002, pp. 620-636.

Singhal, et al., "Amplitude Optimization and Pitch Prediction in Multipulse Coders", IEEE Transactions on Acoustics Speech, and Signal Processing, vol. 37, No. 3, Mar. 1989, pp. 317-327.

Trancoso et al., "Efficient Procedures for Finding the Optimum Innovation in Stochastic Coders", AT&T Bell Laboratories, Murray Hill, NJ 07974, Proc. ICASSP, Tokyo, JP, 1986, pp. 2375-2378.

ITU-T Recommendation G.729, Series G: Transmission Systems and Media, Digital Systems and Networks; Digital Terminal Equipments—Coding of Analogue Signals by Methods other than PCM; "Coding of Speech at 8 Kbit/s Using Conjugate-Structure Algebraic-Code-Excited Linear Prediction", (CS-ACELP), Jan. 2007, pp. 1-146.

ITU-T Recommendation G.729, "Annex A, Reduced Complexity 8 Kbit/s CS-ACELP Speech Codec", Nov. 1996, 7 sheets.

ITU-T Recommendation G.729.1, Series G: Transmission Systems and Media, Digital Systems and Networks; Digital Terminal Equipments—Coding of Analogue Signals by Methods other than PCM, G.729 Based Embedded Variable Bit-Rate Coder: An 8-32 Kbit/s Scalable Wideband Coder Bitstream Interoperable with G.729, May 2006, pp. 1-259.

ITU-T Recommendation G.723.1, Series G: Transmission Systems and Media, Digital Systems and Networks; Digital Terminal Equipments—Coding of Analogue Signals by Methods other than PCM; "Dual Rate Speech Coder for Multimedia Commuications Transmitting at 5.3 and 6.3 Kbit/s", May 2006, pp. 1-64.

3GPP Technical Specification 26.190, "Adaptive Multi-Rate-Wideband (AMR-WB) Speech Codec; Transcoding functions", http://www.3gpp.org, Jul. 2005, 53 pages.

ITU-T Recommendation G.718, Series G: Transmission Systems and Media, Digital Systems and Networks; Digital Terminal Equipments—Coding of Analogue Signals by Methods other than PCM"Frame Error Robust Narrowband and Wideband Embedded Variable Bit-Rate Coding of Speech and Audio from 8-32 Kbit/s" Approved in Sep. 2008, pp. 1-259.

ITU-T Recommendation G.722.2. Series G: Transmission Systems and Media, Digital Systems and Networks; Digital Terminal Equipments—Coding of Analogue Signals by Methods other than PCM; "Wideband Coding of Speech at Around 16 Kbit/s Using Adaptive Multi-Rate Wideband (AMR-WB)", Jul. 2003, pp. 1-72.

ITU-T Telecommunication Standardized Sector, Study Group 16—Contribution 199, VoiceAge, Nokia, "Extended High Level Description of the Q9 EV-VBR Baseline Codec", Jun. 2007, pp. 1-14.

* cited by examiner

METHOD AND DEVICE FOR FAST ALGEBRAIC CODEBOOK SEARCH IN SPEECH AND AUDIO CODING

FIELD

The present invention relates to a method and device for searching a fixed codebook having an algebraic structure. The codebook searching method and device according to the invention can be used in a technique for encoding and decoding sound signals (including speech and audio signals).

BACKGROUND

The demand for efficient digital wideband speech/audio encoding techniques with a good subjective quality/bit rate trade-off is increasing for numerous applications such as audio/video teleconferencing, multimedia, and wireless applications, as well as Internet and packet network applications. Until recently, telephone bandwidths filtered in the range of 200-3400 Hz were mainly used in speech coding applications. However, there is an increasing demand for wideband speech applications in order to increase the intelligibility and naturalness of the speech signals. A bandwidth in the range 50-7000 Hz was found sufficient for delivering a face-to-face speech quality. For audio signals, this range gives an acceptable audio quality, but is still lower than the CD (Compact Disk) quality which operates in the range 20-20000 Hz.

A speech encoder converts a speech signal into a digital bit stream which is transmitted over a communication channel (or stored in a storage medium). The speech signal is digitized (sampled and quantized with usually 16-bits per sample) and the speech encoder has the role of representing these digital samples with a smaller number of bits while maintaining a good subjective speech quality. The speech decoder or synthesizer operates on the transmitted or stored bit stream and converts it back to a sound signal.

One of the best prior art techniques capable of achieving a good quality/bit rate trade-off is the so-called CELP (Code Excited Linear Prediction) technique. According to this technique, the sampled speech signal is processed in successive blocks of L samples usually called frames where L is some predetermined number (corresponding to 10-30 ms of speech). In CELP, an LP (Linear Prediction) synthesis filter is computed and transmitted every frame. The L-sample frame is then divided into smaller blocks called subframes of N samples, where L=kN and k is the number of subframes in a frame (N usually corresponds to 4-10 ms of speech). An excitation signal is determined in each subframe, which usually consists of two components: one from the past excitation (also called pitch contribution or adaptive codebook) and the other from an innovative codebook (also called fixed codebook). This excitation signal is transmitted and used at the decoder as the input of the LP synthesis filter in order to obtain the synthesized speech.

To synthesize speech according to the CELP technique, each block of N samples is synthesized by filtering an appropriate codevector from the innovative codebook through time-varying filters modeling the spectral characteristics of the speech signal. These filters consist of a pitch synthesis filter (usually implemented as an adaptive codebook containing the past excitation signal) and an LP synthesis filter. At the encoder end, the synthesis output is computed for all, or a subset, of the codevectors from the innovative codebook (codebook search). The retained innovative codevector is the one producing the synthesis output closest to the original speech signal according to a perceptually weighted distortion measure. This perceptual weighting is performed using a so-called perceptual weighting filter, which is usually derived from the LP synthesis filter.

In the CELP context, an innovative codebook is an indexed set of N-sample-long sequences which will be referred to as N-dimensional codevectors. Each codebook sequence is indexed by an integer k ranging from 0 to $M_c-1$ where $M_c$ represents the size of the innovative codebook often expressed as a number of bits b, where $M_c=2^b$.

A codebook can be stored in a physical memory, e.g. a look-up table (stochastic codebook), or can refer to a mechanism for relating the index to a corresponding codevector, e.g. a formula (algebraic codebook).

A drawback of the first type of codebooks, the stochastic codebooks, is that they often involve substantial physical storage. They are stochastic, i.e. random in the sense that the path from the index to the associated codevector involves look-up tables which are the result of randomly generated numbers or statistical techniques applied to large speech training sets. The size of stochastic codebooks tends to be limited by storage and/or search complexity.

The second type of codebooks are the algebraic codebooks. By contrast with the stochastic codebooks, algebraic codebooks are not random and require no substantial storage. An algebraic codebook is a set of indexed codevectors of which the amplitudes and positions of the pulses of the $k^{th}$ codevector can be derived from a corresponding index k through a rule requiring no, or minimal, physical storage. Therefore, the size of algebraic codebooks is not limited by storage requirements. Algebraic codebooks can also be designed for efficient search.

The CELP model has been very successful in encoding telephone band sound signals, and several CELP-based standards exist in a wide range of applications, especially in digital cellular applications. In the telephone band, the sound signal is band-limited to 200-3400 Hz and sampled at 8000 samples/sec. In wideband speech/audio applications, the sound signal is band-limited to 50-7000 Hz and sampled at 16000 samples/sec.

An important issue that arises in coding wideband signals is the need to use very large excitation codebooks. Therefore, efficient codebook structures that require minimal storage and can be rapidly searched become very important. Algebraic codebooks have been known for their efficiency and are now widely used in various speech coding standards. Algebraic codebooks with larger number of bits can be searched efficiently using non-exhaustive search methods. Examples are the nested-loop search [4], the depth-first tree search [5] that searches pulses in subsets of pulses, and the global pulse replacement [6]. A simple search was used in ITU-T Recommendation G.723.1 [7] similar to the multipulse sequential search [3]. In Reference [7], the excitation consists of several signed pulses in a frame (no track structure as in ACELP) with a fixed gain for all pulses. The pulses are sequentially searched by updating the so-called backward filtered target signal d(n) and placing the new pulse at the absolute maximum of the signal d(n). The search is repeated for several gain values but the gain is assumed constant during each iteration.

SUMMARY

More specifically, according to the present invention, there is provided a method of searching an algebraic codebook during encoding of a sound signal, wherein the algebraic codebook comprises a set of codevectors formed of a number of pulse positions and a number of pulses each having a sign and distributed over the pulse positions. The algebraic codebook searching method comprises: calculating a reference signal for use in searching the algebraic codebook; in a first stage, (a) determining, in relation with the reference signal and among the number of pulse positions, a position of a first pulse; in each of a number of stages subsequent to the first stage, (a) recomputing an algebraic codebook gain, (b) updating the reference signal using the recomputed algebraic codebook gain and (c) determining, in relation with the updated reference signal and among the number of pulse positions, a position of another pulse; and computing a codevector of the algebraic codebook using the signs and positions of the pulses determined in the first and subsequent stages, wherein a number of the first and subsequent stages corresponds to the number of pulses in the codevectors of the algebraic codebook.

The present invention also relates to a device for searching an algebraic codebook during encoding of a sound signal, wherein the algebraic codebook comprises a set of codevectors formed of a number of pulse positions and a number of pulses each having a sign and distributed over the pulse positions, and wherein the algebraic codebook searching device comprises: means for calculating a reference signal for use in searching the algebraic codebook; means for determining, in a first stage, a position of a first pulse in relation with the reference signal and among the number of pulse positions; means for recomputing an algebraic codebook gain in each of a number of stages subsequent to the first stage, means for updating, in each of the subsequent stages, the reference signal using the recomputed algebraic codebook gain and means for determining, in each of the subsequent stages, a position of another pulse in relation with the updated reference signal and among the number of pulse positions; and means for computing a codevector of the algebraic codebook using the signs and positions of the pulses determined in the first and subsequent stages, wherein a number of the first and subsequent stages corresponds to the number of pulses in the codevectors of the algebraic codebook.

The present invention further relates to a device for searching an algebraic codebook during encoding of a sound signal, wherein the algebraic codebook comprises a set of codevectors formed of a number of pulse positions and a number of pulses each having a sign and distributed over the pulse positions, and wherein the algebraic codebook searching device comprises: a first calculator of a reference signal for use in searching the algebraic codebook; a second calculator for determining, in a first stage, a position of a first pulse in relation with the reference signal and among the number of pulse positions; a third calculator for recomputing an algebraic codebook gain in each of a number of stages subsequent to the first stage, a fourth calculator for updating, in each of the subsequent stages, the reference signal using the recomputed algebraic codebook gain and a fifth calculator for determining, in each of the subsequent stages, a position of another pulse in relation with the updated reference signal and among the number of pulse positions; and a sixth calculator of a codevector of the algebraic codebook using the signs and positions of the pulses determined in the first and subsequent stages, wherein a number of the first and subsequent stages corresponds to the number of pulses in the codevectors of the algebraic codebook.

The foregoing and other objects, advantages and features of the present invention will become more apparent upon reading of the following non restrictive description of illustrative embodiments thereof, given by way of example only with reference to the accompanying drawings.

DETAILED DESCRIPTION

The non-restrictive illustrative embodiment of the present invention is concerned with a method and device for fast codebook search in CELP-based encoders. The codebook searching method and device can be used with any sound signals, including speech and audio signals. The codebook searching method and device can also be applied to narrowband, wideband, or full band signals sampled at any rate.

Figure 1:
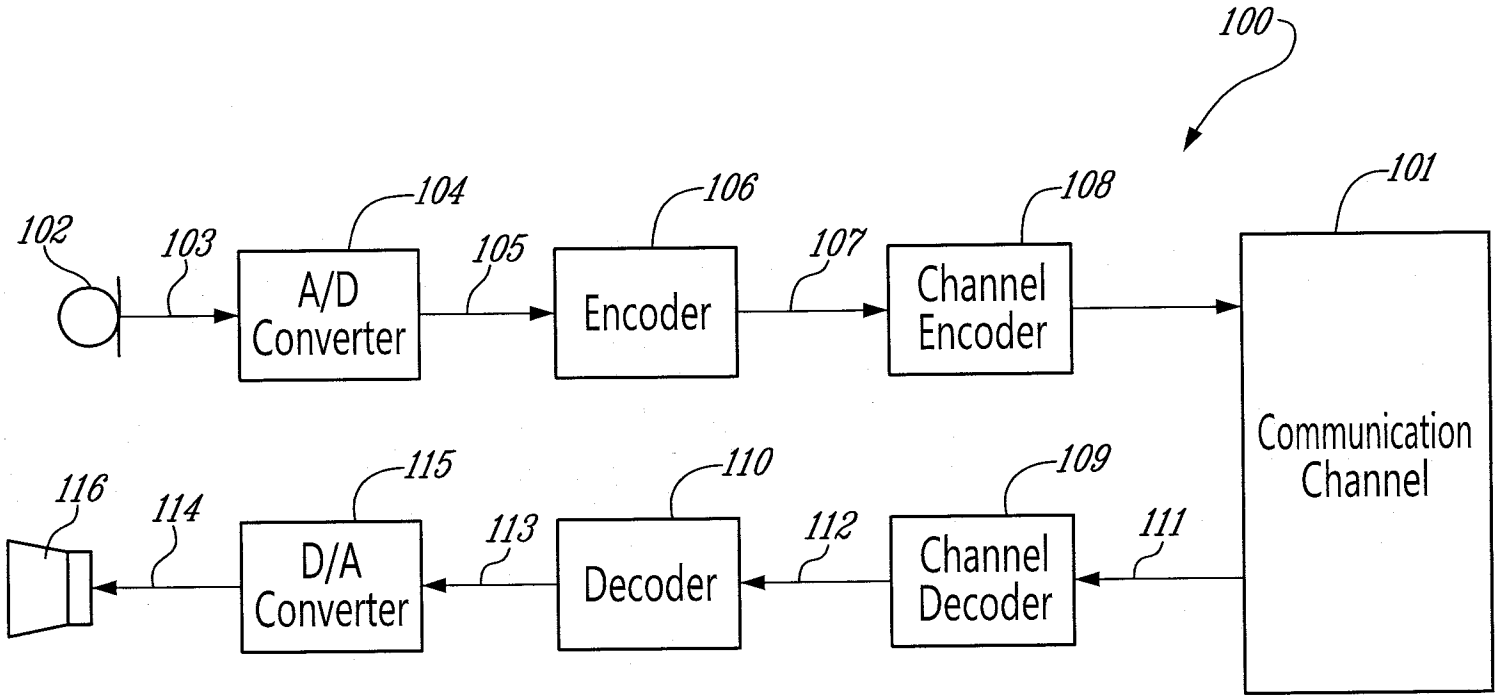
FIG. 1 is a schematic block diagram of a communication system illustrating the use of sound encoding and decoding devices.

FIG. 1 is a schematic block diagram of a sound communication system 100 depicting an example of use of sound encoding and decoding. The sound communication system 100 supports transmission and reproduction of a sound signal across a communication channel 101. Although it may comprise, for example, a wire, optical or fibre link, the communication channel 101 typically comprises at least in part a radio frequency link. The radio frequency link often supports multiple, simultaneous speech communications requiring shared bandwidth resources such as may be found with cellular telephony. Although not shown, the communication channel 101 may be replaced by a storage device in a single device embodiment of the communication system 101 that records and stores the encoded sound signal for later playback.

Still referring to FIG. 1, for example a microphone 102 produces an analog sound signal 103 that is supplied to an analog-to-digital (A/D) converter 104 for converting it into a digital sound signal 105. A sound encoder 106 encodes the digital sound signal 105 thereby producing a set of encoding parameters 107 that are coded into a binary form and delivered to a channel encoder 108. The optional channel encoder 108 adds redundancy to the binary representation of the coding parameters before transmitting them over the communication channel 101. On the receiver side, a channel decoder 109 utilizes the above mentioned redundant information in the received bit stream to detect and correct channel errors that have occurred during the transmission over the communication channel 101. A sound decoder 110 converts the bit stream received from the channel decoder 110 back to a set of encoding parameters for creating a synthesized digital sound signal 113. The synthesized digital sound signal 113 reconstructed in the sound decoder 110 is converted to an analog sound signal 114 in a digital-to-analog (D/A) converter 115 and played back in a loudspeaker unit 116.

Figure 2A:
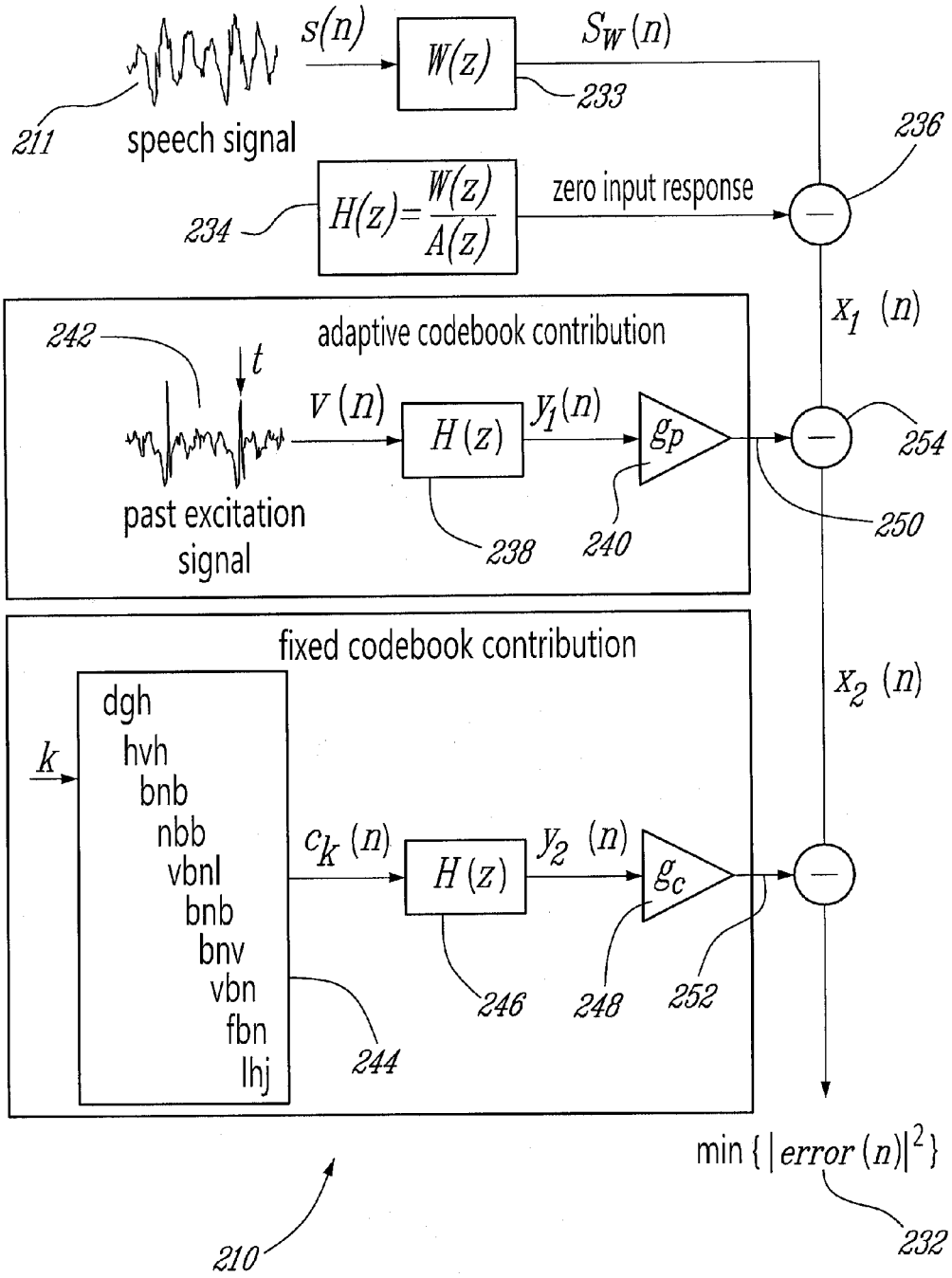
FIG. 2 is a schematic block diagram illustrating the structure of a CELP-based encoder and decoder.
Figure 2B:
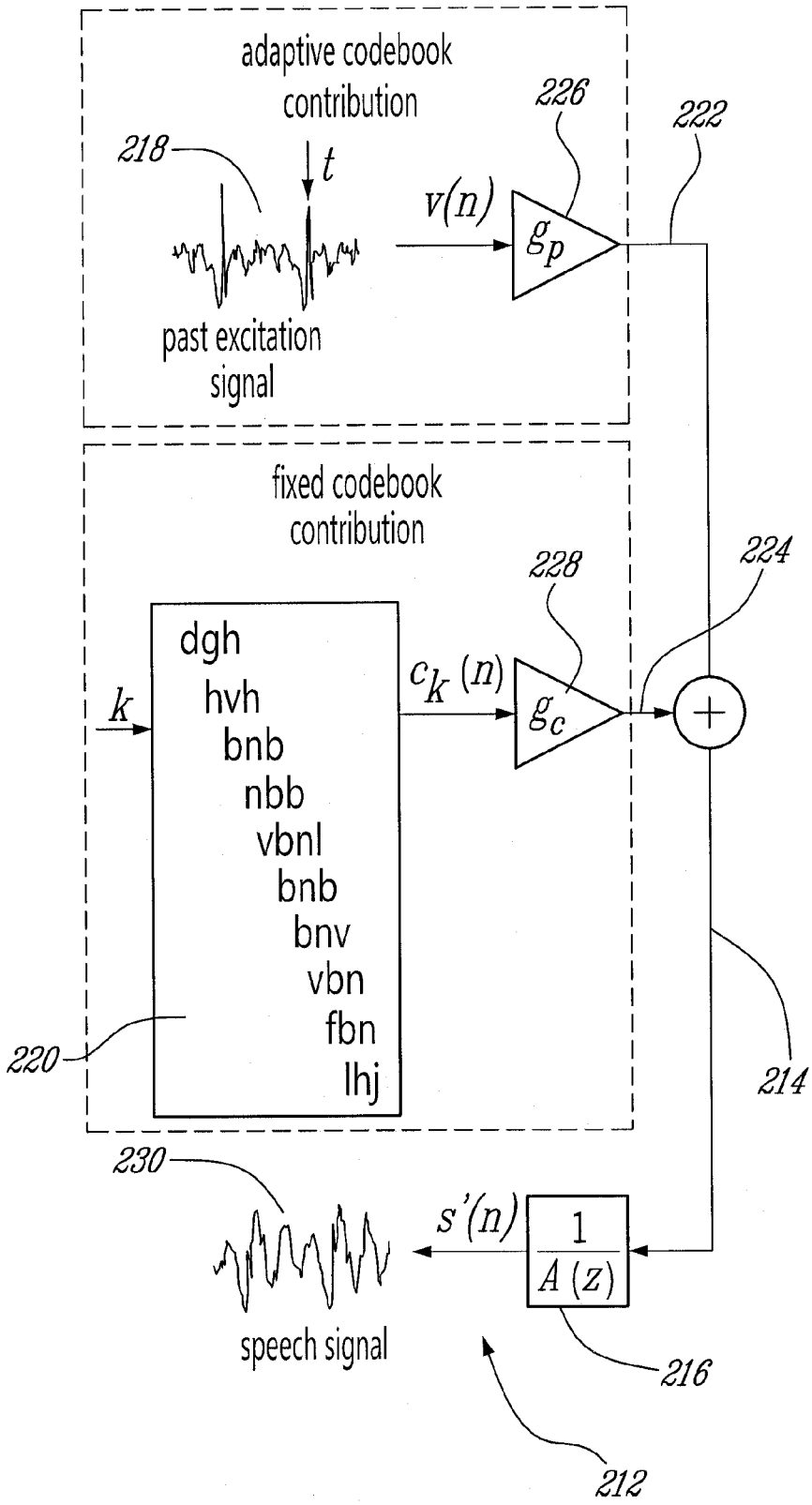

As illustrated in FIGS. 2*a* and 2*b*, a sound codec consists of two basic parts: a sound encoder 210 and a sound decoder 212. The encoder 210 digitizes the sound signal, chooses a limited number of parameters representing the sound signal and converts these parameters into a digital bit stream that is transmitted using a communication channel, for example the communication channel 101 of FIG. 1, to the decoder 212. The sound decoder 212 reconstructs the sound signal to be as similar as possible to the original sound signal.

Presently, the most widespread speech coding techniques are based on Linear Prediction (LP), in particular CELP. In LP-based coding, the sound signal 230 is synthesized by filtering an excitation 214 through a LP synthesis filter 216 having a transfer function. In CELP, the excitation 214 is typically composed of two parts: a first-stage, adaptive-codebook contribution 222 selected from an adaptive codebook 218 and amplified by an adaptive-codebook gain gp 226 and a second-stage, fixed-codebook contribution 224 selected from a fixed codebook 220 and amplified by a fixed-codebook gain gc 228. Generally speaking, the adaptive codebook contribution 222 models the periodic part of the excitation and the fixed codebook contribution 224 is added to model the evolution of the sound signal.

The sound signal is processed by frames of typically 20 ms and the LP filter coefficients are transmitted once per frame. In CELP, the frame is further divided in several subframes to encode the excitation. The subframe length is typically 5 ms.

The main principle behind CELP is called Analysis-by-Synthesis where possible decoder outputs are tried (synthesized) already during the coding process and then compared to the original sound signal. The search minimizes the mean-squared error 232 between the input speech signal s(n) 211 and the synthesized speech s'(n) 230 in a perceptually weighted domain, where discrete time index n=0, 1, . . . , N−1, and N is the length of the subframe. The perceptual weighting filter 233 exploits the frequency masking effect and typically is derived from the LP filter A(z). An example of the perceptual weighting filter 233 is given in Equation (1):

$$W(z) = \frac{A(z/\gamma_1)}{A(z/\gamma_2)}, \tag{1}$$

where the factors $\gamma_1$ and $\gamma_2$ control the amount of perceptual weighting and where $0<\gamma_2<\gamma_1\leq 1$. The traditional perceptual weighting filter of Equation (1) works well for NB (narrowband, bandwidth of 200-3400 Hz) signals. An example of the perceptual weighting filter for WB (wideband, bandwidth of 50-7000 Hz) signals can be found in Reference [2].

Since the memory of the LP synthesis filter 1/A(z) and the weighting filter W(z) is independent of the searched codevectors, this memory can be subtracted from the input speech signal s(n) prior to the fixed codebook search. Filtering of the candidate codevectors can then be done by means of a convolution with the impulse response of the cascade of the filters 1/A(z) and W(z), represented by H(z) in FIG. 1.

The bit stream transmitted from the encoder 210 to the decoder 212 contains typically the following parameters: the quantized parameters of the LP synthesis filter A(z), the adaptive and fixed codebook indices and the gains $g_p$ and $g_c$ of the adaptive and the fixed codebooks. The block diagram of the encoder 210 and the decoder 212 containing the described parameters is shown in FIGS. 2*a* and 2*b*.

Adaptive Codebook Search

The adaptive codebook search in CELP-based codecs will be only briefly described in the following paragraph since such adaptive codebook search is believed to be otherwise well known to those of ordinary skill in the art.

The adaptive codebook search in CELP-based codecs is performed in a weighted speech domain to determine the delay (pitch period) t and the pitch gain (or adaptive codebook gain) $g_p$, and to construct the adaptive codebook contribution of the excitation. The pitch period t is strongly dependent on the particular speaker and its accurate determination critically influences the quality of the synthesized speech.

In recent CELP codecs, a three-stage procedure is used to determine the pitch period t. In the first stage, an estimate $T_{op}$ of the open-loop pitch period is computed for each frame. The open-loop pitch period is typically searched using the weighted sound signal $s_w(n)$ and normalized correlation computation; the weighted sound signal $s_w(n)$ is calculated as shown in FIG. 2*a* by weighting the input sound signal s(n) 211 through the weighting filter W(z) 233. In the second stage, a closed-loop pitch search is performed for integer pitch periods around the estimated open-loop pitch period $T_{op}$ for every subframe of 5 ms. Once an optimum integer pitch period is found, a third stage goes through fractions around that optimum integer pitch period. The closed-loop pitch search is performed by minimizing the mean-squared weighted error 232 between the original and synthesized sound signals. This can be achieved by maximizing the term:

$$\Im_t = \frac{\left(\sum_{n=0}^{N-1} x_1(n)y_1(n)\right)^2}{\sum_{n=0}^{N-1} y_1(n)y_1(n)}, \tag{2}$$

where $x_1(n)$ is the target signal and $y_1(n)$ is the filtered adaptive codevector. As shown in FIG. 2*a*, the filtered adaptive codevector $y_1(n)$ is computed by the convolution of the past excitation signal v(n) from the adaptive codebook 242 at pitch period t with the impulse response h(n) of the weighted synthesis filter H(z) 238:

$$y_1(n)=v(n)*h(n) \tag{3}$$

The filter H(z) 238 is formed by the cascade of the LP synthesis filter 1/A(z) and the perceptual weighting filter W(z). The target signal $x_1(n)$ corresponds to the perceptually weighted input speech signal $s_w(n)$ after subtracting the zero-input response of the filter H(z) (see subtractor 236).

The pitch gain $g_p$ 240 is found by minimizing the mean-squared error between the signals $x_1(n)$ and $y_1(n)$, and given by the following relation:

$$g_p = \frac{\sum_{n=0}^{N-1} x_1(n)y_1(n)}{\sum_{n=0}^{N-1} y_1(n)y_1(n)}. \tag{4}$$

The pitch gain $g_p$ is usually bounded by $0\leq g_p\leq 1.2$. In most CELP implementations, the pitch gain $g_p$ is quantized with the fixed codebook gain once the innovative codevector is found.

The adaptive codebook contribution 250 is calculated by multiplying the filtered adaptive codevector $y_1(n)$ by the pitch gain $g_p$.

Fixed Codebook Search

The objective of searching the fixed (innovative) codebook (FCB) contribution in CELP-based codecs is to minimize the residual error after the use of the adaptive codebook. The residual error is given by the following relation (see subtractor 256 of FIG. 2*a*):

$$E = \min_k \left\{ \sum_{n=0}^{N-1} [x_2(n) - g_c \cdot y_2^{(k)}(n)]^2 \right\}, \tag{5}$$

where $g_c$ is the fixed codebook gain, and $y_2^{(k)}(n)$ is the filtered innovative codevector. k is the fixed codebook index and the filtered innovative codevector $y_2^{(k)}(n)$ is the codevector $c_k(n)$ from the fixed codebook 244 at index k convolved with the impulse response h(n) of the weighted synthesis filter H(z) 246.

The fixed codebook contribution 252 is calculated by multiplying the filtered innovative codevector $y_2^{(k)}(n)$ by the fixed codebook gain $g_c$ 248.

The algebraic fixed codebook target signal $x_2(n)$ is computed by subtracting the adaptive codebook contribution 250 from the adaptive codebook target signal $x_1(n)$ (see subtractor 254):

$$x_2(n) = x_1(n) - g_p y_1(n). \tag{6}$$

Minimizing E from Equation (5) results in the optimum fixed codebook gain $g_c$:

$$g_c^{opi} = \frac{\sum_{n=0}^{N-1} x_2(n) y_2^{(k)}(n)}{\sum_{n=0}^{N-1} \left(y_2^{(k)}(n)\right)^2}, \tag{7}$$

and the minimum error from Equation (5) then results in:

$$E = \sum_{n=0}^{N-1} (x_2(n))^2 - \frac{\left(\sum_{n=0}^{N-1} x_2(n) y_2^{(k)}(n)\right)^2}{\sum_{n=0}^{N-1} \left(y_2^{(k)}(n)\right)^2}. \tag{8}$$

Thus, the search is performed by maximizing the term:

$$\Im_k = \frac{\left(\sum_{n=0}^{N-1} x_2(n) y_2^{(k)}(n)\right)^2}{\sum_{n=0}^{N-1} \left(y_2^{(k)}(n)\right)^2}. \tag{9}$$

The fixed codebook can be implemented in several ways. One of the most frequent implementations consists of using an algebraic codebook [1] in which a set of pulses is placed in each subframe. The efficiency of such an algebraic codebook depends on the number of pulses, their signs, positions and amplitudes. Since large codebooks are used to guarantee a high subjective quality of the coding, an efficient codebook search is also implemented.

In Algebraic CELP (ACELP (Algebraic Code Excited Linear Prediction)) codecs, the algebraic fixed codebook vector (hereinafter denoted as fixed codevector) $c_k(n)$ contains M unit pulses with respective signs $s_j$ and positions $m_j$, and is thus given by the following relation:

$$c_k(n) = \sum_{j=0}^{M-1} s_j \delta(n - m_j), \tag{10}$$

where $s_j = \pm 1$ and $\delta(n)=1$ for n=0, and $\delta(n)=0$ for $n \neq 0$. The fixed codevector after filtering through the filter 246 can be then expressed in the form:

$$y_2^{(k)}(n) = c_k(n) * h(n) = \sum_{j=0}^{M-1} s_j h(n - m_j). \tag{11}$$

In general, the number of pulses M is limited by the bit rate availability. The fixed codebook index (or codeword) k represents the pulse positions and signs in each subframe. Thus no codebook storage is needed, since the selected codevector can be reconstructed at the decoder through the information contained in the index k itself without lookup tables. Unlike the multi-pulse approach [3], the algebraic fixed codebook gain g, is the same for all the pulses.

Let us denote $c_k$ the algebraic codevector at the codebook index k, and $y_2^{(k)}$ the corresponding codevector filtered through the filter H(z) 246 (FIG. 2*a*). The algebraic codebook search in Equation (9) can be then described using matrix notation as a maximization of the following criterion [1]:

$$\Im_k = \frac{\left(x_2^T y_2^{(k)}\right)^2}{\left(y_2^{(k)}\right)^T y_2^{(k)}} = \frac{(x_2^T H c_k)^2}{c_k^T H^T H c_k} = \frac{(d^T c_k)^2}{c_k^T \Phi c_k} = \frac{(C_k)^2}{E_k} \tag{12}$$

Where T denotes vector transpose and H is the lower triangular Toeplitz convolution matrix with diagonal h(0) and lower diagonals h(1), . . . , h(N−1):

$$H = \begin{pmatrix} h_0 & 0 & 0 & \dots & 0 \\ h_1 & h_0 & 0 & \dots & 0 \\ h_2 & h_1 & h_0 & \dots & 0 \\ \vdots & \vdots & \vdots & \ddots & \vdots \\ h_{N-1} & h_{N-2} & h_{N-3} & \dots & h_0 \end{pmatrix}. \tag{13}$$

Vector $d = H^T x_2$ is the correlation between $x_2(n)$ and h(n), also known as the backward filtered target vector (since it can be computed using time-reversed filtering of $x_2(n)$ through the weighted synthesis filter:

$$d(n) = \sum_{k=0}^{N-1} x_2(k) h(k - n) \tag{14}$$

and matrix $\Phi = H^T H$ is the matrix of correlations of h(n). Both d and Φ are usually computed prior to the codebook search. If the algebraic codebook contains only a few non-zero pulses, the computation of the maximization criterion for all possible indexes k is very fast [1].

Algebraic codebooks with larger number of bits can be searched efficiently using non-exhaustive search methods. Examples are the nested-loop search [4], the depth-first tree search [5] that searches pulses in subsets of pulses, and the global pulse replacement [6]. A simple search was used in ITU-T Recommendation G.723.1 [7] similar to the multi-pulse sequential search [3]. In Reference [7], the excitation consists of several signed pulses in a frame (no track structure as in ACELP) with a fixed gain for all pulses. The pulses are sequentially searched by updating the backward filtered target vector d(n) and placing the new pulse at the absolute maximum of d(n). The search is repeated for several gain values but the gain is assumed constant during each iteration. The embodiment of the present invention disclosed in this specification is concerned with a method and device for searching an algebraic codebook wherein the frame can be divided into interleaved tracks of pulse positions and where several pulses are placed in each track. The disclosed codebook searching method and device implement the use of a sequential search of the pulses by maximizing a certain criterion based on a maximum likelihood signal. The fixed codebook gain is then recomputed at each stage. Several iterations can be used by changing the order of the searched tracks.

Several non-restrictive embodiments of the codebook searching method and device will be disclosed in the following description to illustrate the present invention.

Algebraic Fixed Codebook Structure

The codebook structure can be based on an interleaved single-pulse permutation (ISPP) design. In this structure, the pulse positions are divided into several tracks of interleaved positions. For example, a 64-position codevector that is divided into 4 tracks $T_0$, $T_1$, $T_2$ and $T_3$ of interleaved positions results in 16 positions in each track as shown in Table I below. This structure will be used in the following examples.

TABLE I

Potential positions of individual pulses in 20-bit codebook.

| track | pulse | positions |
|---|---|---|
| $T_0$ | $m_0$ | 0, 4, 8, 12, 16, 20, 24, 28, 32, 36, 40, 44, 48, 52, 56, 60 |
| $T_1$ | $m_1$ | 1, 5, 9, 13, 17, 21, 25, 29, 33, 37, 41, 45, 49, 53, 57, 61 |
| $T_2$ | $m_2$ | 2, 6, 10, 14, 18, 22, 26, 30, 34, 38, 42, 46, 50, 54, 58, 62 |
| $T_3$ | $m_3$ | 3, 7, 11, 15, 19, 23, 27, 31, 35, 39, 43, 47, 51, 55, 59, 63 |

If a single signed pulse is placed in each track (M=4), the pulse position is encoded with 4 bits and its sign is encoded with 1 bit, resulting in a 20-bit codebook. If two signed pulses are placed in each track, the two pulse positions are encoded with 8 bits and their corresponding signs can be encoded with only 1 bit by exploiting pulse ordering; therefore a total of 4×(4+4+1)=36 bits are required to specify the pulse positions and signs for this particular algebraic codebook structure. Other codebook structures can be designed, for example, by placing 3, 4, 5 or 6 pulses in each track $T_0$, $T_1$, $T_2$ and $T_3$. The encoding of the pulses in each track is described in Reference [8].

Another example of codebook structure comprises a 64-position codevector divided into 2 tracks $T_0$ and $T_1$ of interleaved positions resulting in 32 positions in each track as shown in Table II. If a single signed pulse is placed in each track, the pulse position is encoded with 5 bits and its sign is encoded with 1 bit, resulting in a 12-bit codebook. Again, other codebook structures can be designed by placing more pulses in each track, or by fixing the signs of some pulses.

TABLE II

Potential positions of individual pulses in 12-bit codebook.

| track | pulse | positions |
|---|---|---|
| $T_0$ | $m_0$ | 0, 2, 4, 6, 8, 10, 12, 14, 16, 18, 20, 22, 24, 26, 28, 30, 32, 34, 36, 38, 40, 42, 44, 43, 48, 50, 52, 54, 56, 58, 60, 62 |
| $T_1$ | $m_1$ | 1, 3, 5, 7, 9, 11, 13, 15, 17, 19, 21, 23, 25, 27, 29, 31, 33, 35, 37, 39, 41, 43, 45, 47, 49, 51, 53, 55, 57, 59, 61, 63 |

Other combinations of number of tracks and number of pulses per track can be used; the above 12-bit and 20-bit codebooks have been shown in detail because they are used in the ITU-T Recommendation G.718 codec implementation framework that will be summarized herein below.

As already stated, in the 20-bit codebook with the structure as described in Table I each pulse position in one track is encoded with 4 bits and the sign of the pulse is encoded with 1 bit. The position index is given by the pulse position in the subframe divided by the number of tracks (integer division). The division remainder gives the track index. For example, a pulse at position 31 has a position index of 31/4=7 and it belongs to the track with index 3 (fourth track). In this illustrative embodiment, the sign index is set to 0 for positive signs and 1 for negative signs. The index of the signed pulse is thus given by the following relation:

$$I_m = m + s \times 2^P. \tag{15}$$

where m is the position index, s is the sign index, and P=4 is the number of bits per track.

The Autocorrelation Approach

A common approach to simplify the FCB (Fixed Codebook) search procedure is to use the autocorrelation method [9]. In accordance with this approach, the matrix of correlations Φ from Equation (12) with elements:

$$\phi(i, j) = \sum_{n=0}^{N-1} h(n-i)h(n-j),\ i, j = 0, \ldots, N-1, \tag{16}$$

is reduced to a Toeplitz form by modifying the summation limits in Equation (16) so that $\phi(i, j) = \alpha(|i-j|)$, where:

$$\alpha(k) = \sum_{n=k}^{N-1} h(n)h(n-k). \tag{17}$$

The autocorrelation approach results from modifying the N×N convolution matrix of Equation (13) into a (2N−1)×N matrix of the form:

$$H = \begin{pmatrix} h_0 & 0 & 0 & \ldots & 0 \\ h_1 & h_0 & 0 & \ldots & 0 \\ h_2 & h_1 & h_0 & \ldots & 0 \\ \vdots & \vdots & \vdots & \ddots & \vdots \\ h_{N-1} & h_{N-2} & h_{N-3} & \ldots & h_0 \\ 0 & h_{N-1} & h_{N-2} & \ldots & h_0 \\ 0 & 0 & h_{N-1} & \ldots & h_0 \\ \vdots & \vdots & \vdots & \ddots & \vdots \\ 0 & 0 & 0 & \ldots & h_{N-1} \end{pmatrix}. \tag{18}$$

The convolution $Hc_k$ using this matrix results into a 2N−1 long codevector obtained when convolving two segments each of length N. In the covariance approach only the first N samples of the convolution are considered and any samples beyond this subframe limit are not taken into consideration. This approach can be used in the technique according to the invention.

Using the autocorrelation approach means that the mean-squared weighted error is minimized over 2N−1 samples. This requires computing the target signal $x_2(n)$ over 2N−1 samples by inputting zero-value samples after the N sound samples into the weighted synthesis filter H(z) 246. Consequently, the computation of the signal $x_2(n)$ given by $d=H^T x_2$ will be modified to take into account the new matrix dimensions. As an approximation, the computation of the signals $x_2(n)$ and d(n) can be performed as in the conventional approach, but the computation of the energy of the filtered fixed codevector $y_2^{(k)}(n)$ can be performed using the autocorrelation approach.

From Equations (10)-(12), it can be shown that for an algebraic fixed codebook with M pulses, the criterion to be maximized can be written as:

$$\Im_k = \frac{(C_k)^2}{E_k} = \frac{(d^T c_k)^2}{c_k^T \Phi c_k} = \frac{\left(\sum_{j=0}^{M-1} s_j d(m_j)\right)^2}{\sum_{j=0}^{M-1} \phi(m_j, m_j) + 2\sum_{i=0}^{M-2}\sum_{j=i+1}^{M-1} s_i s_j \phi(m_i - m_j)}. \tag{19}$$

Using the autocorrelation approach, this can be expressed as:

$$\Im_k = \frac{\left(\sum_{j=0}^{M-1} s_j d(m_j)\right)^2}{M\alpha(0) + 2\sum_{i=0}^{M-2}\sum_{j=i+1}^{M-1} s_i s_j \alpha(|m_i - m_j|)}. \tag{20}$$

From Equation (7), the algebraic codebook gain can be expressed as:

$$g_c = \frac{\sum_{j=0}^{M-1} s_j d(m_j)}{\sum_{j=0}^{M-1} \phi(m_j, m_j) + 2\sum_{i=0}^{M-2}\sum_{j=i+1}^{M-1} s_i s_j \phi(m_i, m_j)}. \tag{21}$$

and in case of the autocorrelation approach:

$$g_c = \frac{\sum_{j=0}^{M-1} s_j d(m_j)}{M\alpha(0) + 2\sum_{i=0}^{M-2}\sum_{j=i+1}^{M-1} s_i s_j \alpha(|m_i - m_j|)}. \tag{22}$$

The autocorrelation approach has been used in sequential multipulse search [3] since, for a single pulse, the search criterion reduces to placing the pulse at the absolute maximum of d(n).

Fast Algebraic Fixed Codebook Search

The method and device for conducting a fast algebraic codebook search in, for example, a fixed codebook will now be described. The general idea behind the method and device for conducting a fast algebraic codebook search is to search pulses sequentially in several iterations. In the following non-restrictive illustrative embodiments, the autocorrelation approach will be used. However the more usual covariance approach [8] can be used as well. The fundamental principle of the method and device resides in updating the fixed codebook gain $g_c$ and the backward filtered target vector d(n) after each new pulse is determined. The basic search can be summarized by the following steps.

1. Compute both the backward filtered target vector d(n) (in this embodiment a reference signal used for searching the algebraic fixed codebook) and the vector α(n) (or the matrix Φ in case of the covariance approach) in advance using Equations (14) and (17), i.e. before the iterative part of the search procedure is entered.
2. In the first stage of each iteration, the first pulse position $m_0$ is set typically at the absolute maximum of the backward filtered target vector d(n), n being the sample index in the subframe of length N (or by maximizing $d^2(m_0)/\phi(m_0,m_0)$ in case of the covariance approach). The pulse sign is given by the sign of $d(m_0)$.
3. In the following stages (after each new pulse is determined) the algebraic fixed codebook gain $g_c$ is recomputed, and the gain $g_c$ is then used to update the backward filtered target vector d(n).
4. The position of each new pulse $m_j$ is found as an absolute maximum of the updated backward filtered target vector d(n) and the pulse sign is given by the sign of the sample $d(m_j)$.
5. To achieve higher coding efficiency, the above steps 2-4 can be iterated starting with different positions of $m_0$ (e.g. second largest absolute maximum of d(n) in the $2^{nd}$ iteration, third largest absolute maximum of d(n) in the $3^{rd}$ iteration etc.). The iteration that maximizes the search criterion of Equation (12) is finally used for the selection of the pulse positions.

The following description explains the use of the method and device for conducting a fast algebraic codebook search in fixed codebooks that consist of several tracks of interleaved positions, where M is the number of pulses, L the number of tracks and N the subframe length. First a description of the specific situation where M=L=4 will be given. The procedure will be then generalized for M pulses (when still M=L) and further extended for the case where M≠L.

Generic Procedure for the Disclosed Search Method and Device

An example of implementation of the method and device for conducting a fast algebraic codebook search, for searching a fixed codebook with 4 tracks of pulse positions and one pulse per track will now be described.

The FCB search procedure starts with computing the backward filtered target vector d(n) (in this embodiment a reference signal used for searching the algebraic fixed codebook) defined by Equation (14) and the vector α(k) defined by Equation (17) (or the matrix φ(i, j) defined by Equation (16)). In the following description, the index i represents the position of a pulse in a track (see Table I or Table II), and the index n represents the number of a sample in a subframe, wherein n=0, . . . , N−1.

In the first iteration, $m_0$ designates the pulse position determined in track $T_0$, $m_1$ the pulse position determined in track $T_1$, $m_2$ the pulse position determined in track $T_2$ and $m_3$ the pulse position determined in track $T_3$.

For a single pulse, the criterion in Equation (19) is reduced to:

$$\Im_k = \frac{d^2(m_0)}{\phi(m_0, m_0)} \tag{23}$$

and in case of the autocorrelation approach, Equation (20) is reduced to:

$$\Im_k = \frac{d^2(m_0)}{\alpha(0)} \tag{24}$$

As can be seen from Equation (24), the position of the first pulse is found as the index of the maximum absolute value of the backward filtered target vector d(i) for $i \in T_0$, i.e.:

$$m_0 = \text{index}(\max(|d(i)|)) \tag{25}$$

and its sign is given by the sign of $d(m_0)$, i.e.:

$$s_0 = \text{sgn}(d(m_0)). \tag{26}$$

From Equation (22), the gain of the first pulse is given by the relation:

$$g_c^{(0)} = \frac{s_0 d(m_0)}{\phi(m_0, m_0)} = \frac{|d(m_0)|}{\phi(m_0, m_0)}, \tag{27}$$

or in the case of the autocorrelation approach by the relation:

$$g_c^{(0)} = \frac{s_0 d(m_0)}{\alpha(0)} = \frac{|d(m_0)|}{\alpha(0)}. \tag{28}$$

In the second stage (second pulse search), the target signal is updated by subtracting the first pulse contribution from the target signal $x_2(n)$ as follows:

$$x_2^{(1)}(n) = x_2(n) - g_c^{(0)} y_2^{(0)}(n). \tag{29}$$

The upper index in brackets used above is from the range [0, . . . , M−1] and corresponds to the searched pulse number j. Note that the codebook index k is omitted for the sake of simplicity and clarity to describe the signal $y_2^{(k)}(n)$.

Using Equation (11), the Equation (29) can be written as:

$$x_2^{(1)}(n) = x_2(n) - g_c^{(0)} s_0 h(n - m_0). \tag{30}$$

To find the second pulse position and gain, the backward filtered target vector d(i) for $i \in T_1$ is updated as follows:

$$\begin{aligned} d^{(1)}(i) &= \sum_{n=0}^{N-1} x_2^{(1)}(n) h(n-i) \\ &= \sum_{n=0}^{N-1} (x_2(n) - s_0 g_c^{(0)} h(n - m_0)) h(n-i) = \\ &= d(i) - s_0 g_c^{(0)} \phi(i, m_0) \end{aligned} \tag{31}$$

In case of the autocorrelation approach, the backward filtered target vector d(n) is updated as follows:

$$d^{(1)}(i) = d(i) - s_0 g_c^{(0)} \alpha(|i - m_0|) \tag{32}$$

Similar to Equations (25) and (26), the position and sign of the second pulse are found for $i \in T_1$ using the following relations:

$$m_1 = \text{index}(\max(|d^{(1)}(i)|)), \tag{33}$$

$$s_1 = \text{sgn}(d^{(1)}(m_1)). \tag{34}$$

The third stage is performed in the same manner as the second stage. The only difference is that we take into account both first and second pulse contributions to find the position and sign of the third pulse.

From Equation (21), the gain $g_c$ after two pulses is recomputed using the following relation:

$$g_c^{(1)} = \frac{s_0 d(m_0) + s_1 d(m_1)}{\phi(m_0, m_0) + \phi(m_1, m_1) + 2 s_0 s_1 \phi(m_0, m_1)} \tag{35}$$

and from Equation (22) for the autocorrelation approach:

$$g_c^{(1)} = \frac{s_0 d(m_0) + s_1 d(m_1)}{2\alpha(m_0) + 2 s_0 s_1 \alpha(|m_0 - m_1|)}. \tag{36}$$

The update of the target signal is made using the following relation:

$$x_2^{(2)}(n) = x_2(n) - g_c^{(1)} y_2^{(1)}(n) = x_2(n) - g_c^{(1)} s_0 h(n - m_0) - g_c^{(1)} s_1 h(n - m_1) \tag{37}$$

and the update of the vector d(i) for $i \in T_2$ is made using the following relation:

$$\begin{aligned} d^{(2)}(i) &= \sum_{n=0}^{N-1} x_2^{(2)}(n) h(n-i) \\ &= \sum_{n=0}^{N-1} (x(n) - s_0 g_c^{(1)} h(n - m_0) - s_1 g_c^{(1)} h(n - m_1)) h(n-i) \\ &= d(i) - s_0 g_c^{(1)} \phi(i, m_0) - s_1 g_c^{(1)} \phi(i, m_1) \end{aligned} \tag{38}$$

and using the autocorrelation approach by the following relation:

$$d^{(2)}(i) = d(i) - s_0 g_c^{(1)} \alpha(|i - m_0|) - s_1 g_c^{(1)} \alpha(|i - m_1|). \tag{39}$$

Similar to Equations (25) and (26), the position and the sign of the third pulse are found for $i \in T_2$ as follows:

$$m_2 = \text{index}(\max(|d^{(2)}(i)|)), \tag{40}$$

$$s_2 = \text{sgn}(d^{(2)}(m_2)). \tag{41}$$

Similarly, in the fourth stage, using the autocorrelation approach, the update of the backward filtered target vector d(n) is made for $i \in T_3$ as follows:

$$d^{(3)}(i) = d(i) - s_0 g_c^{(2)} \alpha(|i - m_0|) - s_1 g_c^{(2)} \alpha(|i - m_1|) - s_2 g_c^{(2)} \alpha(|i - m_2|), \tag{42}$$

where the fixed codebook gain $g_c^{(2)}$ for the third pulse is given by:

$$g_c^{(2)} = \frac{s_0 d(m_0) + s_1 d(m_1) + s_2 d(m_2)}{3\alpha(m_0) + 2s_0 s_1 \alpha(|m_0 - m_1|) + 2s_0 s_2 \alpha(|m_0 - m_2|) + 2s_1 s_2 \alpha(|m_1 - m_2|)} \quad (43)$$

and the position and sign of the fourth pulse are found for $i \in T_3$ using the following relations:

$$m_3 = \text{index}(\max(|d^{(3)}(i)|)), \quad (44)$$

$$s_3 = \text{sgn}(d^{(3)}(m_3)). \quad (45)$$

Using the above procedure, the positions and signs of all 4 pulses are found.

The above procedure is repeated L=4 times by starting each iteration at a different track. For example, in the second iteration, pulse position $m_0$ is assigned to track $T_1$, pulse position $m_1$ is assigned to track $T_2$, pulse position $m_2$ is assigned to track $T_3$, and pulse position $m_3$ is assigned to track $T_0$. Finally, the selected pulse positions and signs of the iteration that minimizes the mean-squared weighted error are chosen to form the final fixed codevector and filtered fixed codevector. More specifically, after all the iterations, the best set of pulse positions and signs are chosen as the those that maximize the following criteria:

$$\Im_k = \frac{\left(\sum_{j=0}^{M-1} s_j d(m_j)\right)^2}{\sum_{n=0}^{N-1} \left(y_2^{(k)}(n)\right)^2}, \quad (46)$$

where $y_2^{(k)}(n)$ is given by Equation (11) for an optimal codebook index k.

This procedure can be easily extended to more than 4 pulses and for different methods of performing the iterations. Also this procedure can be extended to the case where several pulses are placed in each track of pulse positions.

For the case of 4 pulses in 4 tracks, the procedure can be summarized as below using the following assumptions. The pulses are searched sequentially and the backward filtered target vector d(n) (in this embodiment a reference signal used for searching the algebraic fixed codebook) is updated at each stage. The number of stages is equal to the number of pulses M. The number of iterations is equal to the number of tracks L. The autocorrelation approach is used.

1. The procedure is repeated in L (corresponding to the number of tracks of pulse positions) iterations starting at a different track for each iteration.
2. Each iteration consists of M (corresponding to the number of pulses) stages. The pulses are searched one by one, one track at a time.
3. The backward filtered target vector d(n) and the vector $\alpha(n)$ are both computed in advance using Equations (14) and (17) before the iteration part of the search procedure is entered.
4. During each iteration, the first stage consists of determining the first pulse position $m_0$. It is typically set at the absolute maximum of the backward filtered target vector d(n) in the initial track. The pulse sign is given by the sign of $d(m_0)$.
5. In the following stages, the fixed codebook gain $g_c$ is recomputed after each new pulse is determined, and it is also used to update the backward filtered target vector d(n).
6. The position of the new pulse $m_1$ is found as an absolute maximum of the updated backward filtered target vector d(n) and the pulse sign is given by the sign of the sample $d(m_j)$.
7. The above operations 4-6 of the procedure are repeated L times starting with respective, different tracks. The iteration that maximizes the search criterion of Equation (12) is finally used as the selection of the pulse positions and signs.

Procedure for Searching M Pulses in M Tracks

The method and device for conducting a fast algebraic codebook search as described in above can be further generalized for M pulses as follows. In this example, the number of tracks is equal to the number of pulses to search, that is M=L.

The procedure can be summarized by the following operations:

1. Compute the backward filtered target vector d(n) (in this embodiment the reference signal used for searching the algebraic fixed codebook) and the correlation vector $\alpha(n)$.
2. Conduct the first iteration. Assign pulse position $m_0$ to track $T_0$, pulse position $m_1$ to track $T_1$, pulse position $m_2$ to track $T_2$, pulse position $m_3$ to track T3, . . . , pulse position $m_{M-1}$ to track $T_{M-1}$ (one pulse per track is assumed).
3. Determine position and sign of the first pulse by computing:

$$m_0 = \text{index}(\max(|d(i)|)), \quad (47)$$

$$s_0 = \text{sgn}(d(m_0)) \quad (48)$$

for $i \in T_0$.

4. Determine the position and sign of the second pulse by computing:

$$G_N^{(0)} = s_0 d(m_0), \quad (49)$$

$$G_D^{(0)} = \alpha(0), \quad (50)$$

$$g_c^{(0)} = \frac{G_N^{(0)}}{G_D^{(0)}}, \quad (51)$$

$$d^{(1)}(i) = d(i) - g_c^{(0)} s_0 \alpha(|i - m_0|), \quad (52)$$

$$m_1 = \text{index}(\max(|d^{(1)}(i)|)), \quad (53)$$

$$s_1 = \text{sgn}(d^{(1)}(m_1)), \quad (54)$$

for $i \in T_1$.

5. Determine the position and sign of the other pulses by computing for j=2 to M−1:

$$G_N^{(j-1)} = G_N^{(j-2)} + s_{j-1} d(m_{j-1}), \quad (55)$$

$$G_D^{(j-1)} = G_D^{(j-2)} + \alpha(0) + 2\sum_{k=0}^{j-2} s_k s_{j-1} \alpha(|m_k - m_{j-1}|), \quad (56)$$

$$g_c^{(j-1)} = \frac{G_N^{(j-1)}}{G_D^{(j-1)}}, \quad (57)$$

-continued $$d^{(j)}(i) = d(i) - g_c^{(j-1)} \sum_{k=0}^{j-1} s_k \alpha(|i - m_k|), \tag{58}$$

$$m_j = \text{index}(\max(|d^{(j)}(i)|)), \tag{59}$$

$$s_j = \text{sgn}(d^{(j)}(m_j)), \tag{60}$$

where $i \in T_3$.

6. Compute the fixed codevector $c_k(n)$ and filtered fixed codevector $y_2^{(K)}(n)$ using Equations (10) and (11), respectively.
7. Repeat the procedure from operation 2 by assigning the pulses to different tracks. The number of iterations is equal to L.
8. Choose the set of pulses corresponding to the iteration that maximizes the criterion of Equation (46).

Procedure for Searching M Pulses in L Tracks

The above procedure can be further extended for a situation where a number of M pulses is searched in a number of L tracks, M being an integer multiple of L. In this example, there are several pulses per track. This situation also covers the case when only one track is used (i.e. the general case when the ISPP approach is not used).

The pulses in the same track are searched sequentially using Equations (47) to (60). The pulses in a track are searched for all the positions of the track. There could be some situations when two or more pulses occupy the same position. If these pulses have the same signs, they add and strengthen the codebook contribution at this position. The case where the pulses have opposite signs is not allowed.

The sequential search of multiple pulses per track is sensitive to the search pulse order. There are two basic sequential search approaches that can be used. The first one supposes that all the pulses in one track are searched before searching the other tracks. The second approach supposes that the first pulse is searched in track $T_0$, the second pulse in track $T_1$, etc. If needed, the pulses are searched again in the following tracks up to track $T_{L-1}$, one pulse per track, etc. An example of these two approaches is shown in Table III. As experimentally observed the second approach achieves better results and is therefore used in the following example of implementation. If more complexity can be afforded, both approaches can be used however resulting in more iterations.

TABLE III

Two approaches of searching M pulses in L tracks.

| | track | |
|---|---|---|
| pulse | approach I | approach II |
| $m_0$ | $T_0$ | $T_0$ |
| $m_1$ | $T_0$ | $T_1$ |
| $m_2$ | $T_1$ | $T_2$ |
| $m_3$ | $T_1$ | $T_3$ |
| $m_4$ | $T_2$ | $T_0$ |
| $m_5$ | $T_2$ | $T_1$ |
| $m_6$ | $T_3$ | $T_2$ |
| $m_7$ | $T_3$ | $T_3$ |

An example for M = 8 and L = 4 is shown here.

Yet another approach can be based on some criterion to select the track the next pulse is searched in. Such criterion can be, for example, the absolute maximum of the backward filtered target vector d(n) or its update. The criterion can be used only to select tracks where all the pulses have not yet been assigned.

Search within a Reference Signal

To further improve the efficiency of the search procedure, the amplitude and sign of the pulses can be determined on the basis of a reference signal b(n). In the signal-selected pulse amplitude approach used for example in AMR-WB [8], the sign of a pulse at position n is set equal to the sign of the reference signal at that position. Also, the reference signal b(n) can be used to set the positions of some pulses in case of very large algebraic codebooks. The application of the signal-selected pulse amplitude approach in the presented procedure will be discussed later. In the present non-restrictive, illustrative embodiment, the reference signal b(n) is defined as a combination of the backward filtered target vector d(n) and the ideal excitation signal r(n).

The reference signal can be expressed as follows:

$$b''(n) = (1 - \delta)\frac{r(n)}{\sqrt{E_r}} + \delta\frac{d(n)}{\sqrt{E_d}}, \tag{61}$$

which is a weighted sum of the normalized backward filtered target vector d(n) and the ideal excitation signal r(n). $E_d = d^T d$ is the energy of the backward filtered target vector, and $E_r = r^T r$ is the energy of the ideal excitation signal. The value of δ is closer to 1 for small number of pulses and closer to zero for large number of pulses. The reference signal can be also expressed as follows:

$$b(n) = \frac{\sqrt{E_d}}{1 - \delta} b''(n) = \sqrt{\frac{E_d}{E_r}}\, r(n) + \beta d(n), \tag{62}$$

where the scaling factor $\beta = \delta/(1-\delta)$. In typical implementations, β=4 for 2 pulses (δ=0.8), β=2 for 4 pulses (δ=0.66), and β=1 for 8 pulses (δ=0.5).

The ideal excitation signal r(n) is obtained by filtering the target signal $x_2(n)$ through the inverse of the weighted synthesis filter H(z) with zero states. This can be also done by first filtering the target signal $x_1(n)$ through the inverse of the filter H(z) with zero states giving $r_0(n)$. The signal $r_0(n)$ is then updated by subtracting the selected adaptive vector contribution, i.e. $r(n) = r_0(n) - g_p v(n)$ for n=0, . . . , N−1.

The signal $r_0(n)$, or a part of this signal, can be approximated by the LP residual signal to save complexity. In the present exemplary implementation, the signal $r_0(n)$ is computed by filtering of the target signal $x_1(n)$ through the inverse of the filter H(z) only in the first half of the subframe. The LP residual signal is used in the second half of the subframe. This LP residual signal is calculated using the following relation:

$$r_0(n) = s(n) + \sum_{k=1}^{16} \hat{a}_k s(n-k) \quad n = \frac{N}{2}, \ldots, N-1, \tag{63}$$

where $\hat{a}_k$ are quantized LP filter coefficients and s(n) is the input speech signal.

As mentioned herein above, the scaling factor β in Equation (62) controls the dependence of the reference signal b(n) on the backward filtered target vector d(n) and is generally lowered as the number of pulses increases. This approach makes an intelligent guess on the potential positions to be considered. The reference signal b(n) defined by Equation (62) is used for determining the pulse positions.

Figure 3:
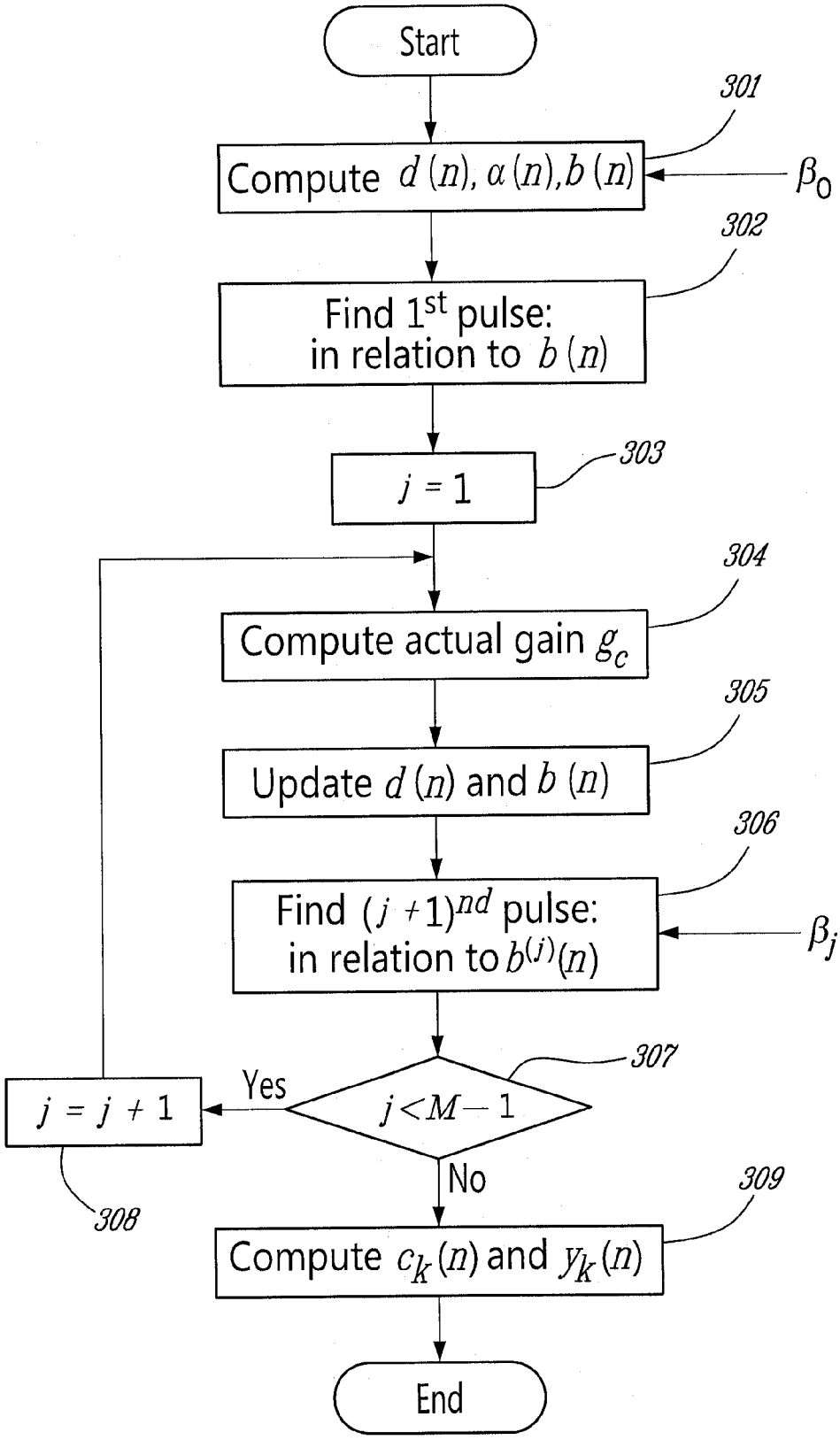
FIG. 3 is a block diagram illustrating an embodiment of the algebraic fixed codebook searching method and device according to the invention.

The procedure for searching pulses using the reference signal b(n) can be summarized with the following operation in connection with FIG. 3. Let us suppose that ISSP approach is not used here. Only equations different from equations in the previous sections are shown:

1. In operation 301, a calculator computes the backward filtered target vector d(n), the correlation vector $\alpha(n)$ and the reference signal b(n).
2. In operation 302, a calculator calculates the position and sign of the first pulse using the following relations:

$$m_0=\text{index}(\max(|b(n)|)), \tag{64}$$

$$s_0=\text{sgn}(b(m_0)). \tag{65}$$

The reference signal b(n) is computed using Equation (62) with energies $E_d$ and $E_r$ computed over the whole subframe for all N values.

3. In operation 303, the pulse index j is set to 1.
4. Calculators compute Equations (49) to (52) to determine the fixed codebook gain $g_c$ of the first pulse (Operation 304) and update, in operation 305, the backward filtered target vector d(n) and the reference signal b(n) to finally calculate the position and sign of the second pulse (Operation 306):

$$b^{(1)}(n) = \sqrt{\frac{E_d}{E_r}}\, r(n) + \beta d^{(1)}(n), \tag{66}$$

$$m_1 = \text{index}(\max(|b^{(1)}(n)|)), \tag{67}$$

$$s_1 = \text{sgn}(b^{(1)}(m_1)). \tag{68}$$

5. Determine positions of the other pulses for j=2 to M−1 (Operations 307 and 308) using Equations (55)-(58) in operations 304-306:

$$b^{(j)}(n) = \sqrt{\frac{E_d}{E_r}}\, r(n) + \beta d^{(1)}(n), \tag{69}$$

$$m_j = \text{index}(\max(|b^{(j)}(n)|)), \tag{70}$$

$$s_j = \text{sgn}(b^{(j)}(m_j)). \tag{71}$$

6. In operation 309, a calculator computes algebraic codevector $c_k(n)$ and filtered algebraic codevector $y_2^{(k)}(n)$ using Equations (10) and (11), respectively.

When ISSP approach is used, the procedure above changes as follows. After the above step 1, an iteration process is started. In the first iteration, pulse position $m_0$ is assigned to track $T_0$, pulse position $m_1$ to track $T_1$, pulse position $m_2$ to track $T_2$, pulse position $m_3$ to track $T_3$, . . . , pulse position $m_{M-1}$ to track $T_{M-1}$, wherein one pulse per track is assumed (M=L). The procedure than continues up to step 6. Then the procedure is repeated from operations 302 to 309 by assigning the pulses to different tracks. The number of iterations is equal to L. Finally choose the set of pulse positions and signs that maximizes the criterion of Equation (46).

The value of $E_r$ is constant during all the search procedure and, therefore, can be computed only once at the beginning of the search procedure. The values of $E_d$ have to be recomputed in each stage of every iteration because they use values of updated backward filtered target vector $d^{(1)}(i)$. Further in relation to step 4, energies $E_d$ and $E_r$ can be computed again for all N values, but to save complexity, they can also be computed for values in the corresponding track only. $E_d$ then represents the energy of the updated signal $d^{(1)}(i)$ and, similarly, $E_r$ then represents the energy of signal r(i) for i in a corresponding track only. Similar in step 5, energies $E_d$ and $E_r$ correspond again to NIL samples of $d^{(j)}(i)$ and r(i) only.

The value of the scaling factor $\beta$ used in the previous equations is constant for all stages. However its value can be changed according to the stage of the search making the value of the scaling factor adaptive. The idea is to increase its value for later stages. This will emphasize the contribution of the updated backward filtered target vector d(n) in the reference signal b(n) for higher stages where the number of pulses left to be determined reduces. In fact, the reference signal b(n) can be in higher stages approximated by the updated backward filtered target vector d(n) only and the procedure from the previous section can be used in higher stages. An example is described further by Equations (87) and (88). The adaptive scaling factor is symbolized in FIG. 3 by $\beta_j$, j=0, . . . , M−1.

Preselection of Signs

To further simplify the search, the signal-selected pulse amplitude method described in Reference [10] can be used. Then, the sign of the pulse at a certain position is set equal to the sign of the reference signal b(n) from Equation (62) at that position. For that purpose, a vector $z_b(n)$ containing the signs of the original reference signal b(n) is constructed. The vector $z_b(n)$ is computed at the beginning of the codebook search process, i.e. prior to entering the iteration loop. In this manner, the signs of the pulses which are searched are pre-selected and Equations (64) and (65) are changed for the following equations:

$$m_0=\text{index}(\max(z_b(n)\cdot b(n))), \tag{72}$$

$$s_0=z_b(m_0) \tag{73}$$

For the other stages the same principle is used and the position and sign of the pulse for j=1 to M−1 are determined using the following relations:

$$m_j=\text{index}(\max(z_b(n)\cdot b^{(j)}(n))), \tag{74}$$

$$s_j=z_b(m_j). \tag{75}$$

The same principle of sign pre-selection can also be used in relation to a search using the backward filtered target vector d(n) where the vector $z_b(n)$ contains the signs of the original backward filtered target vector d(n).

Track Order Determination

As indicated in the foregoing description, the search procedure searches pulses sequentially track by track. The order of the tracks can be chosen sequentially in accordance with the track number, i.e. for the 20-bit algebraic fixed codebook the first iteration searches tracks in the order $T_0$-$T_1$-$T_2$-$T_3$, the second iteration in the order $T_1$-$T_2$-$T_3$-$T_0$, etc. However the sequential order of tracks is not optimal and another order of tracks could be advantageous. One possible solution is to order the tracks in accordance with the absolute maximum of the reference signal b(n) in the respective track.

As an example of track ordering, let us suppose a 20-bit algebraic fixed codebook. Further, $b_{T0}^{max}$ is defined as the absolute maximum value of the reference signal b(n) in track $T_0$, $b_{T1}^{max}$ as the absolute maximum value of b(n) in track $T_1$, $b_{T2}^{max}$ as the absolute maximum value of b(n) in track $T_2$ and $b_{T3}^{max}$ as the absolute maximum value of b(n) in track $T_3$. Prior to entering the iteration loop in the search procedure the absolute maximum values of b(n) of the respective tracks are arranged in descending order. Let it be $b_{T1}^{max}>b_{T3}^{max}>b_{T2}^{max}>b_{T0}^{max}$ in the above example. Then the first iteration searches the tracks in the order $T_0$-$T_1$-$T_3$-$T_2$, the second iteration in the order $T_1$-$T_3$-$T_2$-$T_0$, the third iteration in the order $T_2$-$T_1$-$T_3$-$T_0$, and the fourth iteration in the order $T_3$-$T_1$-$T_2$-$T_0$.

The above example track order determination helps to find a more accurate estimate of the potential position of a pulse. This track order determination is implemented in the ITU-T Recommendation G.718 codec. In the case the search is conducted using the backward filtered target vector d(n), the same principle can be used to arrange the track order.

Summary of the Search Procedure

Figure 4:
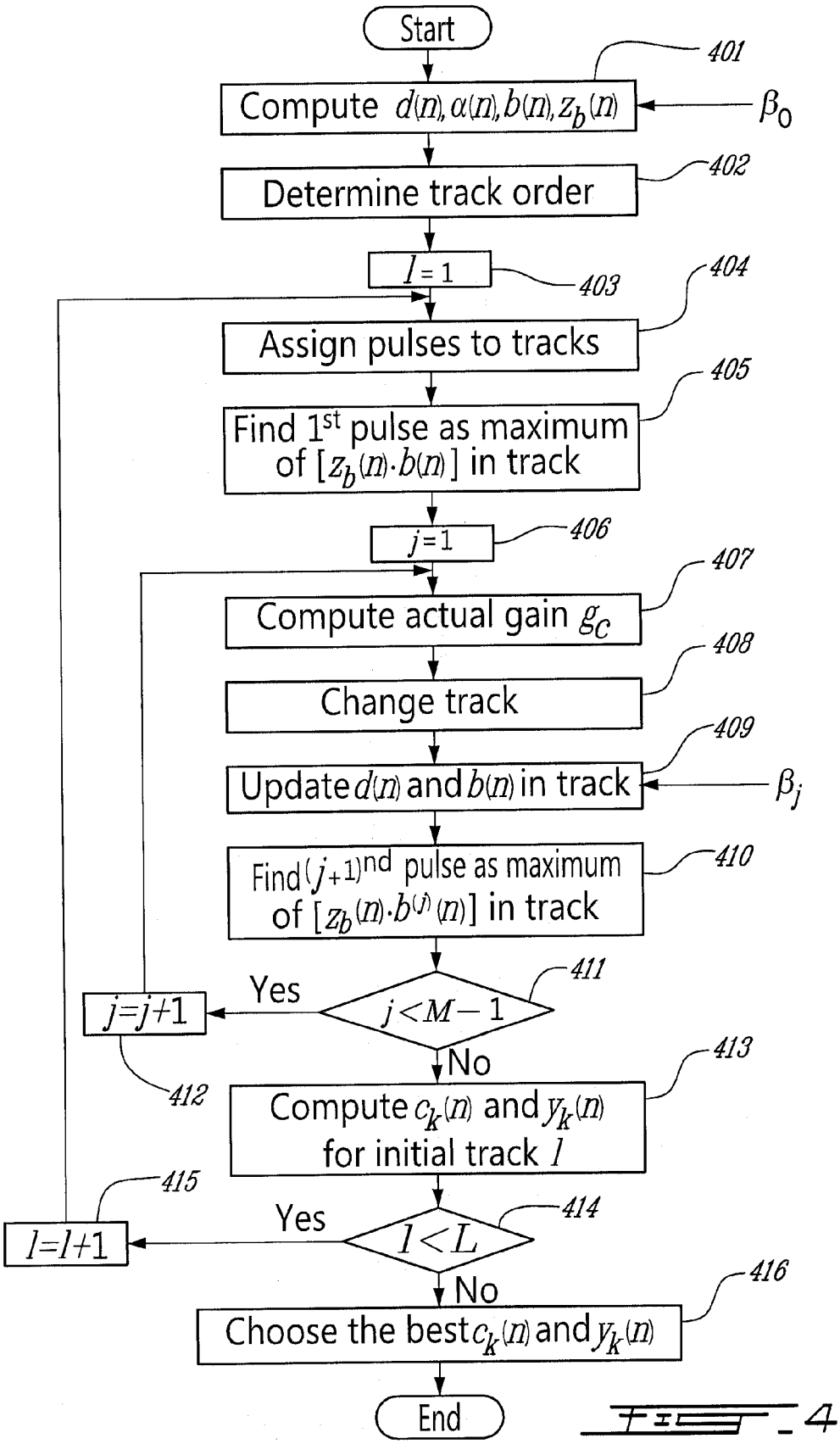
FIG. 4 is a block diagram illustrating another embodiment of the algebraic fixed codebook searching method and device according to the present invention.

The fast algebraic codebook search method and device can be summarized as follows with reference to FIG. 4, when using a search with the reference signal b(n), the autocorrelation approach, ordering of the tracks and pre-selection of the signs of the pulses. The ISPP approach is used here.

1. In operation 401, a calculator calculates the backward filtered target vector d(n), the correlation vector $\alpha(n)$, the reference signal b(n), and the sign vector $z_b(n)$.
2. In operation 402, a calculator determines the order of the tracks.
3. In operation 403, the iteration index l is set to 1.
4. In operation 404, in each iteration, a calculator determines an assignation of the pulses to the tracks starting each iteration with a different track and ordering remaining tracks in correspondence with the track determination from step 2.
5. In operation 405, in the first stage, a calculator determines the position of the first pulse as the index of maximum absolute value of the reference signal b(i), i corresponding to the appropriate track. The sign of the first pulse can be found by means of the sign vector $z_b(i)$.

$$m_0=\text{index}[\max(z_b(i)\cdot b(i))], \tag{76}$$

$$s_0=z_b(m_0), \tag{77}$$

for i in a given track. It should be noted that in Equation (76) a sign vector instead of a more computationally complex absolute value is used to find the maximum in the reference signal b(i).

6. In operation 406, the pulse index is set to j=1.
7. In operation 407, a calculator calculates the fixed codebook gain $g_c$ for the first pulse. The fixed codebook gain for the previously found pulses (pulses $m_0, \ldots, m_{j-1}$) is given by the following relation:

$$g_c^{(j-1)} = \frac{g_N^{(j-1)}}{g_D^{(j-1)}}, \tag{78}$$

where the numerator and denominator are expressed as follows:

$$g_N^{(j-1)} = g_N^{(j-2)} + s_{j-1}d(m_{j-1}), \quad \text{and} \tag{79}$$

$$g_D^{(j-1)} = g_D^{(j-2)} + \alpha(0) + 2\sum_{k=0}^{j-2} s_k s_{j-1}\alpha(|m_k - m_{j-1}|), \tag{80}$$

with the initialization $g_N^{(-1)}=0$ and $g_D^{(-1)}=0$.

8. In operation 408, the track is changed.
9. In operation 409, a calculator updates the target signal by subtracting the contributions of the found pulses from the original target signal $x_2(n)$. Using Equation (11), this can be written as follows:

$$x_2^{(j)}(i) = x_2(i) - g_c^{(j-1)}\sum_{k=0}^{j-1} s_k h(i - m_k), \tag{81}$$

for i corresponding to the appropriate track. Now substituting (i) from Equation (81) in Equation (14) and using Equation (17), a calculator determines an update of the backward filtered target vector d(i) as follows:

$$d^{(j)}(i) = d(i) - g_c^{(j-1)}\sum_{k=0}^{j-1} s_k \alpha(|i - m_k|). \tag{82}$$

Now the reference signal b(i) is updated using the following relation:

$$b^{(j)}(i) = \sqrt{\frac{E_d}{E_r}}\, r(i) + \beta_j d^{(j)}(i), \tag{83}$$

where $\beta_j$ in Equation (83) is the adaptive scaling factor value.

10. In operation 410, a calculator calculates the position and signs of the second pulse similarly to Equations (76) and (77) as follows:

$$m_j=\text{index}[\max(z_b(i)\cdot b^{(j)}(i))], \tag{84}$$

$$s_j=z_b(m_j). \tag{85}$$

11. In operation 411, if the index j of the pulse is smaller than M−1, the index j is increased by 1 before returning to operations 407-410 in order to determine the position and sign of the next pulse. This is repeated until all the stages of iteration l=1 have been completed, i.e. until the position and sign of all the pulses have been found.
12. In operation 411, if the index j of the pulse is equal to M−1, a calculator calculates the fixed codevector $c_k(n)$ and filtered fixed codevector $y_2^{(k)}(n)$ in operation 413 using Equation (10) and (11), respectively.
13. In operation 414, if the index l of the iteration is smaller than L, the number of iterations, the index l is incremented by 1 in operation 415 and the next iteration is made by returning to the operation 404-413. This is repeated until all the iterations have been completed.
14. In operation 414, if the index l of the iteration is equal to L, a selector selects the set of pulse positions and signs calculated in one of the different L iterations and that maximizes the criterion of Equation (46) in operation 416 as the found (best) fixed codevector $c_k(n)$ and filtered fixed codevector $y_2^{(k)}(n)$.

Implementation of the Fast Codebook Search in G.718 Codec

The fast algebraic fixed codebook searching method and device described above was implemented and tested with the ITU-T Recommendation G.718 (previously known as G.EV-VBR) codec baseline that has been recently standardized. The implementation of the fast algebraic fixed codebook search in the G.718 codec correspond to the implementation described above with reference to FIG. 4. The G.718 codec is an embedded codec comprising 5 layers where higher layer bit streams can be discarded without affecting the decoding of the lower layers. The first layer (L1) uses a classification-based ACELP technique, the second layer (L2) uses an algebraic codebook technique to encode the error signal from the first layer, and the higher layers use the MDCT technique to further encode the error signal from the lower layers. The codec is also equipped with an option to allow for interoperability with ITU-T Recommendation G.722.2 codecs at 12.65 kbit/s. When invoked at the encoder, this option enables the use of the G.722.2 mode 2 (12.65 kbit/s) to replace the first and second layers L1 and L2. The algebraic FCB search is thus employed in the first two layers, or in the G.722.2 core layer in case of the G.722.2 option. All of them use an internal sampling frequency of 12.8 kHz both for narrowband and wideband input signals and a frame length of 20 ms. Each frame is divided into four subframes of N=64 samples.

The coding of the first layer L1 takes advantage of a signal classification based encoding. Four distinct signal classes are considered in the ITU-T Recommendation G.718 codec for different coding of each frame: Unvoiced coding, Voiced coding, Transition coding, and Generic coding. The algebraic FCB search in L1 employs 20-bit and 12-bit codebooks. Their use in different subframes depends on the coding mode. The FCB search in layer L2 employs the 20-bit codebook in two subframes and the 12-bit codebook in the other two subframes in Generic and Voiced coding frame and the 20-bit codebook in three subframes and the 12-bit codebook in one subframe in Transition and Unvoiced coding frame. The FCB search in G.722.2 option employs 36-bit codebooks in all four subframes. The configuration of these codebooks is summarized in Table IV.

TABLE IV

Summary of algebraic fixed codebooks configurations used in G.718 codec.

| codebook | number of tracks | number of pulses | positions per track | pulses per track |
|---|---|---|---|---|
| 12-bit | 2 | 2 | 32 | 1 |
| 20-bit | 4 | 4 | 16 | 1 |
| 36-bit | 4 | 8 | 16 | 2 |

The value of scaling factor β can be set as a constant (same for all stages) as follows:

$$\beta = \begin{cases} 2 & \text{for 36-bit codebook} \\ 2 & \text{for 20-bit codebook} \\ 4 & \text{for 12-bit codebook} \end{cases} \tag{86}$$

Nevertheless, as mentioned above, the value of the scaling factor β can be different for every stage. In an example of implementation, it was found that the optimum values of the scaling factor β were the following for a 20-bit algebraic fixed codebook:

$$\beta = \begin{cases} 2.00 & \text{in the first stage} \\ 2.25 & \text{in the second stage} \\ \infty & \text{in the third and forth stage} \end{cases} \tag{87}$$

and for a 12-bit codebook:

$$\beta = \begin{cases} 4.00 & \text{in the first stage} \\ \infty & \text{in the second stage} \end{cases} \tag{88}$$

The value β=∞ means that the updated reference signal b(n) is equal to the updated backward filtered target vector d(n) in this stage.

The criterion of Equation (12) can be used in the codec as described above. However to avoid division when comparing between two candidate values, the criterion is implemented using multiplications only, for details see for example Reference [8].

Fast Codebook Search Performance

The performance of the fast algebraic fixed codebook searching method and device described above was tested in the G.718 codec where the original FCB search [8] was replaced by the above described one. The objective was to achieve similar synthesized speech quality with a decrease of complexity.

Tables V to X summarize the new fast FCB search performance measured using segmental signal-to-noise ratio (segmental SNR) values, In the tables, 'FCB 1' stands for the technique presented in Reference [8], 'FCB 2' for the technique presented in Reference [6], and the technique presented in this report is called 'new FCB'. A database of clean speech sentences at nominal level comprising both male and female English speakers was used as a speech material. The length of the database was about 456 seconds. The performance of the method within the G.718 codec was evaluated in layers where algebraic fixed codebook search is used, i.e. for layers L1, L2 and the G.722.2-option core layer. This resulted in 3 groups of tests: 8 kbps tests (only layer L1), 12 kbps tests (layers L1 and L2 are used), and G.722.2-option tests for 12.65 kbps. The above described technique was implemented both in 12-bit FCB and 20-bit FCB using algorithms described above. For the G.722.2 option the above described technique was implemented in the 36-bit FCB.

The complexity of the FCB search and the total G.718 encoder complexity are summarized in Table VII and Table IX. The complexity is given in wMOPS (weighted Million Operations Per Second) for the worst case.

TABLE V

Performance within G.718 codec for 12 kbps (L1, L2).

| version | segmental SNR [dB] |
|---|---|
| FCB 1 | 8.992 |
| New FCB in L1 and L2 | 8.760 |
| New FCB in L2 only | 8.950 |

TABLE VI

Performance within G.718 codec for 8 kbps (L1).

| version | segmental SNR [dB] |
|---|---|
| FCB 1 | 7.354 |
| New FCB | 7.107 |

The New FCB is used in 20-bit codebook only.

TABLE VII

Complexity for the worst case within G.718 codec for 12 kbps (L1, L2).

| version | Encoder [wMOPS] | 20-bit FCB search [wMOPS] | 12-bit FCB search [wMOPS] |
|---|---|---|---|
| FCB 1 | 47.110 | 12.203 | 3.817 |
| New FCB in L1 and L2 | 38.054 | 4.105 | 0.805 |
| New FCB in L2 only | 43.006 | 8.911 | 2.883 |

TABLE VIII

Performance within G.718 codec for G.722.2 option.

| version | segmental SNR [dB] |
|---|---|
| FCB 1 | 10.090 |
| New FCB | 9.761 |

TABLE IX

Complexity for the worst case within G.718 codec for G.722.2 option.

| version | Encoder [wMOPS] | FCB search [wMOPS] |
|---|---|---|
| FCB 1 | 34.694 | 9.664 |
| New FCB | 29.600 | 4.556 |

As can be seen from Tables V-VII, the presented algorithm reduces computational requirements significantly, but for a cost of a little segmental SNR decrease compared to technique presented in Reference [8]. Therefore it was decided to use the proposed algorithm only in the second layer (L2) in G.718 where the SNR drop is insignificant. The Recommendation G.718 thus employs the fast algebraic fixed codebook search in layer 2. The implementation corresponds to the implementation described above with reference to FIG. 4.

The performance was also tested in ITU-T Recommendation G.729.1 codec [6] at 8 kbps where the original FCB search [6] was replaced by the fast algebraic fixed codebook searching method and device described hereinabove. The G.729.1 codec uses 4 subframes of 40 samples. The position of the pulses $m_0$, $m_1$ and $m_2$ are encoded with 3 bits each, while position of the pulse $m_3$ is encoded with 4 bits. The sign of each pulse sign is encoded with 1 bit. This gives a total of 17 bits for the 4 pulses.

TABLE X

Performance within G.729.1 codec.

| version | segmental SNR [dB] |
|---|---|
| FCB 2 | 10.157 |
| New FCB | 10.235 |

Although the present invention has been described in the foregoing specification in relation to non-restrictive illustrative embodiments thereof, these embodiments can be modified at will within the scope of the appended claims without departing from the spirit and nature of the present invention.

REFERENCES

[1] R. Salami, C. Laflamme, J-P. Adoul, and D. Massaloux, "A toll quality 8 kb/s speech codec for the personal communications system (PCS)", IEEE Trans. on Vehicular Technology, Vol. 43, No. 3, pp. 808-816, August 1994.

[2] B. Bessette, R. Salami, R. Lefebvre, M. Jelinek, J. Rotola-Pukkila, J. Vainio H. Mikkola, and K. Jarvinen, "The Adaptive Multi-Rate Wideband Speech Codec (AMR-WB)", Special Issue of IEEE Transactions on Speech and Audio Processing, Vol. 10, No. 8, pp. 620-636, November 2002.

[3] S. Singhal and B. S. Atal, "Amplitude optimization and pitch prediction in multipulse coders". *IEEE Trans. ASSP*, vol. 37, no. 3, pp. 317-327, March 1989

[4] ITU-T Recommendation G.729 (1/2007), "Coding of Speech at 8 kbit/s using Conjugate-Structure Algebraic-Code-Excited Linear Prediction (CS-ACELP)," January 2007.

[5] ITU-T Recommendation G.729 Annex A (11/96), "Reduced complexity 8 kbit/s CS-ACELP speech codec", November 1996.

[6] ITU-T Recommendation G.729.1 (05/2006), "G.729 based Embedded Variable bit-rate coder: An 8-32 kbit/s scalable wideband coder bitstream interoperable with G.729," May 2006.

[7] ITU-T Recommendation G.723.1 (05/2006), "Dual rate speech coder for multimedia communications transmitting at 5.3 and 6.3 kbit/s", May 2006.

[8] 3GPP Technical Specification 26.190, "Adaptive Multi-Rate—Wideband (AMR-WB) speech codec; Transcoding functions," July 2005; http://www.3gpp.org.

[9] I. M. Trancoso and B. S. Atal, "Efficient procedures for finding the optimum innovation in stochastic coders". *Proc. ICASSP* '86, pp. 2375-2378, 1986.

[10] U.S. Pat. No. 5,754,976: Algebraic codebook with signal-selected pulse amplitude/position combinations for fast coding of speech.

[11] ITU-T Recommendation G.718 "Frame error robust narrowband and wideband embedded variable bit-rate coding of speech and audio from 8-32 kbit/s" Approved in September 2008.

What is claimed is:

1. A method, implemented in an encoder having at least one calculator, of searching an algebraic codebook during encoding of a sound signal, wherein the algebraic codebook comprises a set of codevectors formed of a number of pulse positions and a number of pulses each having a sign and distributed over the pulse positions, and wherein the algebraic codebook searching method comprises:

calculating, using the at least one calculator, a reference signal for use in searching the algebraic codebook;

in a first stage, (a) determining, using the at least one calculator, in relation with the reference signal and among the number of pulse positions, a position of a first pulse;

in each of a number of stages subsequent to the first stage, using the at least one calculator to (a) recompute an algebraic codebook gain, (b) update the reference signal using the recomputed algebraic codebook gain and (c) determine, in relation with the updated reference signal and among the number of pulse positions, a position of another pulse;

computing, using the at least one calculator, a codevector of the algebraic codebook using the signs and positions of the pulses determined in the first and subsequent stages, wherein a number of the first and subsequent stages corresponds to the number of pulses in the codevectors of the algebraic codebook.

2. An algebraic codebook searching method as defined in claim 1, wherein the number of pulse positions are divided into a set of tracks of pulse positions.

3. An algebraic codebook searching method as defined in claim 2, comprising:

in a first iteration, (a) determining for the first and subsequent stages a first assignation of the positions of the first and other pulses to the tracks of pulse positions and (b) conducting the first stage and the number of subsequent stages and the computation of the codevector of the algebraic codebook using this first assignation; and in each of a number of iterations subsequent to the first iteration, (a) determining for the first and subsequent stages another assignation of the positions of the first and other pulses to the tracks of pulse positions and (b) conducting the first stage and the number of subsequent stages and the computation of the codevector of the algebraic codebook using said other assignation.

4. An algebraic codebook searching method as defined in claim 2, wherein the pulse positions are interleaved in the tracks of pulse positions.

5. An algebraic codebook searching method as defined in claim 3, comprising selecting one of the codevectors computed in the first and subsequent iterations using a given selection criterion.

6. An algebraic codebook searching method as defined in claim 1, comprising:

in the first stage, determining the sign of the first pulse in relation with the reference signal; and in each of the number of stages subsequent to the first stage, determining the sign of said other pulse in relation to the updated reference signal.

7. An algebraic codebook searching method as defined in claim 1, wherein calculating the reference signal comprises calculating a backward filtered target vector.

8. An algebraic codebook searching method as defined in claim 1, wherein calculating the reference signal comprises calculating the reference signal as a combination of a backward filtered target vector and an ideal excitation signal.

9. An algebraic codebook searching method as defined in claim 1, comprising controlling the dependence of the reference signal to a backward filtered target vector through a scaling factor.

10. An algebraic codebook searching method as defined in claim 9, comprising changing the scaling factor in each of the subsequent stages.

11. An algebraic codebook searching method as defined in claim 1, wherein:

in the first stage, determining the position of the first pulse comprises setting the position of the first pulse at a maximum of the reference signal; and in each of the number of subsequent stages, determining the position of the other pulse comprises setting the position of the other pulse at a maximum of the updated reference signal.

12. An algebraic codebook searching method as defined in claim 3, comprising starting each iteration at a different track.

13. An algebraic codebook searching method as defined in claim 1, comprising pre-selecting the signs of the first and other pulses.

14. An algebraic codebook searching method as defined in claim 3, comprising determining an order of the tracks of pulse positions for each iteration.

15. An algebraic codebook searching method as defined in claim 13, wherein pre-selecting the signs of the first and other pulses comprises constructing a vector containing the signs of the first-calculated non-updated reference signal.

16. An algebraic codebook searching method as defined in claim 15, wherein determining the position of the other pulse comprises setting the position of the other pulse at a maximum of a product of the updated reference signal and the vector containing the signs.

17. A device for searching an algebraic codebook during encoding of a sound signal, wherein the algebraic codebook comprises a set of codevectors formed of a number of pulse positions and a number of pulses each having a sign and distributed over the pulse positions, and wherein the algebraic codebook searching device comprises:

means for calculating a reference signal for use in searching the algebraic codebook;

means for determining, in a first stage, a position of a first pulse in relation with the reference signal and among the number of pulse positions;

means for recomputing an algebraic codebook gain in each of a number of stages subsequent to the first stage, means for updating, in each of the subsequent stages, the reference signal using the recomputed algebraic codebook gain and means for determining, in each of the subsequent stages, a position of another pulse in relation with the updated reference signal and among the number of pulse positions;

means for computing a codevector of the algebraic codebook using the signs and positions of the pulses determined in the first and subsequent stages, wherein a number of the first and subsequent stages corresponds to the number of pulses in the codevectors of the algebraic codebook.

18. A device for searching an algebraic codebook during encoding of a sound signal, wherein the algebraic codebook comprises a set of codevectors formed of a number of pulse positions and a number of pulses each having a sign and distributed over the pulse positions, and wherein the algebraic codebook searching device comprises:

a first calculator of a reference signal for use in searching the algebraic codebook;

a second calculator for determining, in a first stage, a position of a first pulse in relation with the reference signal and among the number of pulse positions;

a third calculator for recomputing an algebraic codebook gain in each of a number of stages subsequent to the first stage, a fourth calculator for updating, in each of the subsequent stages, the reference signal using the recomputed algebraic codebook gain and a fifth calculator for determining, in each of the subsequent stages, a position of another pulse in relation with the updated reference signal and among the number of pulse positions;

a sixth calculator of a codevector of the algebraic codebook using the signs and positions of the pulses determined in the first and subsequent stages, wherein a number of the first and subsequent stages corresponds to the number of pulses in the codevectors of the algebraic codebook.

19. An algebraic codebook searching device as defined in claim 18, wherein the number of pulse positions are divided into a set of tracks of pulse positions.

20. An algebraic codebook searching device as defined in claim 18, wherein:

in a first iteration, (a) a seventh calculator determines for the first and subsequent stages a first assignation of the positions of the first and other pulses to the tracks of pulse positions and (b) the second, third, fourth and fifth calculators conduct the first stage and the number of subsequent stages and the sixth calculator computes the codevector of the algebraic codebook using this first assignation; and in each of a number of iterations subsequent to the first iteration, (a) an eighth calculator determines for the first and subsequent stages another assignation of the positions of the first and other pulses to the tracks of pulse positions and (b) the second, third, fourth and fifth calculators conduct the first stage and the number of subsequent stages and the fifth calculator computes the codevector of the algebraic codebook using said other assignation.

21. An algebraic codebook searching device as defined in claim 19, wherein the pulse positions are interleaved in the tracks of pulse positions.

22. An algebraic codebook searching device as defined in claim 20, comprising a selector of one of the codevectors computed in the first and subsequent iterations using a given selection criterion.

23. An algebraic codebook searching device as defined in claim 18, wherein:

in the first stage, the second calculator determines the sign of the first pulse in relation with the reference signal; and in each of the number of stages subsequent to the first stage, the fifth calculator determines the sign of said other pulse in relation to the updated reference signal.

24. An algebraic codebook searching device as defined in claim 18, wherein the first calculator calculates a backward filtered target vector as the reference signal.

25. An algebraic codebook searching device as defined in claim 18, wherein the first calculator calculates the reference signal as a combination of a backward filtered target vector and an ideal excitation signal.

26. An algebraic codebook searching device as defined in claim 18, wherein the first calculator controls the dependence of the reference signal to a backward filtered target vector through a scaling factor.

27. An algebraic codebook searching device as defined in claim 26, wherein the first calculator changes the scaling factor in each of the subsequent stages.

28. An algebraic codebook searching device as defined in claim 18, wherein:

in the first stage, the second calculator determines the position of the first pulse by setting the position of the first pulse at a maximum of the reference signal; and in each of the number of subsequent stages, the fifth calculator determines the position of the other pulse by setting the position of the other pulse at a maximum of the updated reference signal.

29. An algebraic codebook searching device as defined in claim 18, comprising means for starting each iteration at a different track.

30. An algebraic codebook searching device as defined in claim 18, comprising a ninth calculator for pre-selecting the signs of the first and other pulses.

31. An algebraic codebook searching device as defined in claim 20, comprising a ninth calculator for determining an order of the tracks of pulse positions for each iteration.

32. An algebraic codebook searching device as defined in claim 30, wherein the ninth calculator pre-selects the signs of the first and other pulses by constructing a vector containing the signs of the first-calculated non-updated reference signal.

33. An algebraic codebook searching device as defined in claim 32, wherein the fifth calculator sets the position of the other pulse at a maximum of a product of the updated reference signal and the vector containing the signs.

* * * * *